US005576745A

United States Patent [19]

Matsubara

[11] Patent Number: 5,576,745

[45] Date of Patent: Nov. 19, 1996

[54] RECORDING APPARATUS HAVING THERMAL HEAD AND RECORDING METHOD

[75] Inventor: Miyuki Matsubara, Tokyo, Japan

[73] Assignee: Canon Kabushiki Kaisha, Tokyo, Japan

[21] Appl. No.: 248,492

[22] Filed: May 24, 1994

[30] Foreign Application Priority Data

May 27, 1993 [JP] Japan ..... 5-125930

[51] Int. Cl.[6] ..... B41J 2/05

[52] U.S. Cl. ..... 347/14; 347/17; 347/19; 347/194

[58] Field of Search ..... 347/14, 17, 35, 347/194, 19

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. | 347/56 |
| 4,740,796 | 4/1988 | Endo et al. | 347/56 |
| 5,066,961 | 11/1991 | Yamashita | 347/194 |
| 5,107,276 | 4/1992 | Kneezel | 347/14 |
| 5,122,816 | 6/1992 | Poeppel | 347/194 X |
| 5,223,853 | 6/1993 | Wysocki et al. | 347/14 |

FOREIGN PATENT DOCUMENTS

| | | | |
|---|---|---|---|
| 0442705 | 8/1991 | European Pat. Off. | B41J 2/05 |
| 0443801 | 8/1991 | European Pat. Off. | B41J 2/05 |
| 0481625 | 4/1992 | European Pat. Off. | B41J 2/05 |
| 505154 | 9/1992 | European Pat. Off. | B41J 2/07 |
| 526223 | 2/1993 | European Pat. Off. | B41J 2/07 |
| 54-056847 | 5/1979 | Japan | B41M 5/26 |
| 59-123670 | 7/1984 | Japan | B41J 3/04 |
| 59-138461 | 8/1984 | Japan | B41J 3/04 |
| 60-071260 | 4/1985 | Japan | B41J 3/04 |
| 5-031906 | 2/1993 | Japan | B41J 2/12 |

*Primary Examiner*—Joseph W. Hartary

*Attorney, Agent, or Firm*—Fitzpatrick, Cella, Harper & Scinto

[57] ABSTRACT

A mounted thermal head is energized to determine a thermal change state of the thermal head and a driving condition of the mounted thermal head is set in accordance with the determined thermal change state. The drive condition of the recording head can be self-set at a high precision with a simple construction and stabilization of the recording characteristics and a long lifetime are attained.

58 Claims, 16 Drawing Sheets

FIG. 8

DRIVE CONDITION SETTING TABLE

| TEMP RISE AMPLITUDE (℃) | REF DRIVE PULSE WIDTH |
|---|---|
| < 10.0 | HEAD ABNORMAL (RE-MEASUREMENT) |
| 10.0 ~ 10.5 | 4.50 μsec |
| 10.5 ~ 11.0 | 4.39 |
| 11.0 ~ 11.5 | 4.23 |
| 11.5 ~ 12.0 | 4.08 |
| 12.0 ~ 12.5 | 3.93 |
| 12.5 ~ 13.0 | 3.78 |
| 13.0 ~ 13.5 | 3.64 |
| 13.5 ~ 14.0 | 3.50 |
| 14.0 ≧ | HEAD ABNORMAL (RE-MEASUREMENT) |

P1 : PRE-PULSE (−T1) (PWM)
P2 : INTERVAL (=T2 −T1)
P3 : MAIN PULSE (=T3 −T2)
Vop : DRIVE VOLTAGE

FIG. 14A

HEAD TEMPERATURE PRE-PULSE TABLE (1)

| PRE-PULSE NO. | 1 | 2 | 3 | 4 | 5 | 6 | 7 | 8 | 9 | 10 | 11 |
|---|---|---|---|---|---|---|---|---|---|---|---|
| HEAD TEMP [℃] | <36 | 36 ~ 38 | 38 ~ 40 | 40 ~ 42 | 42 ~ 44 | 44 ~ 46 | 46 ~ 48 | 48 ~ 50 | 50 ~ 52 | 52 ~ 54 | ≧54 |
| PRE-PULSE WIDTH [μ sec] | 1.87 | 1.68 | 1.49 | 1.31 | 1.12 | 0.93 | 0.75 | 0.56 | 0.37 | 0.19 | 0.19 |

FIG. 14B

HEAD TEMPERATURE PRE-PULSE TABLE (2)

| PRE-PULSE NO. | 1 | 2 | 3 | 4 | 5 | 6 | 7 | 8 | 9 | 10 | 11 |
|---|---|---|---|---|---|---|---|---|---|---|---|
| HEAD TEMP [℃] | <36 | 36 ~ 38 | 38 ~ 40 | 40 ~ 42 | 42 ~ 44 | 44 ~ 46 | 46 ~ 48 | 48 ~ 50 | 50 ~ 52 | 52 ~ 54 | ≧54 |
| PRE-PULSE WIDTH [μ sec] | 2.05 | 1.87 | 1.68 | 1.49 | 1.31 | 1.12 | 0.93 | 0.75 | 0.56 | 0.37 | 0.19 |

FIG. 14C

HEAD TEMPERATURE PRE-PULSE TABLE (3)

| PRE-PULSE NO. | 1 | 2 | 3 | 4 | 5 | 6 | 7 | 8 | 9 | 10 | 11 |
|---|---|---|---|---|---|---|---|---|---|---|---|
| HEAD TEMP [℃] | <36 | 36 ~ 38 | 38 ~ 40 | 40 ~ 42 | 42 ~ 44 | 44 ~ 46 | 46 ~ 48 | 48 ~ 50 | 50 ~ 52 | 52 ~ 54 | ≧54 |
| PRE-PULSE WIDTH [μ sec] | 1.68 | 1.49 | 1.31 | 1.12 | 0.93 | 0.75 | 0.56 | 0.37 | 0.19 | 0.19 | 0.19 |

FIG. 17

DRIVE CONDITION SETTING TABLE

| TEMP RISE AMPLITUDE (HEAT RADIATION LARGE) | REF DRIVE PULSE WIDTH | TEMP RISE AMPLITUDE (HEAT RADIATION SMALL) |
|---|---|---|
| < 9.5 | (RE-MEASUREMENT) | < 10.5 |
| ~ 10.0 | 4.50 μsec | ~ 11.0 |
| ~ 10.5 | 4.39 | ~ 11.5 |
| ~ 11.0 | 4.23 | ~ 12.0 |
| ~ 11.5 | 4.08 | ~ 12.5 |
| ~ 12.0 | 3.93 | ~ 13.0 |
| ~ 12.5 | 3.78 | ~ 13.5 |
| ~ 13.0 | 3.64 | ~ 14.0 |
| ~ 13.5 | 3.50 | ~ 14.5 |
| ≧ 13.5 | (RE-MEASUREMENT) | ≧ 14.5 |

FIG. 18

TEMP REDUCTION TABLE ($\times 10^{-3}$deg)

| ELAPSED TIME (sec) | CONDUCTIVE POWER RATE (%) AT REF TIME | | | | | | | | | |
|---|---|---|---|---|---|---|---|---|---|---|
| | ~10 | ~20 | ~30 | ~40 | ~50 | ~60 | ~70 | ~80 | ~90 | ~100 |
| 0.02 | 50 | 100 | 150 | 200 | 250 | 300 | 350 | 400 | 450 | 500 |
| 0.04 | 46 | 93 | 139 | 184 | 230 | 277 | 322 | 369 | 416 | 462 |
| 0.06 | 43 | 85 | 128 | 170 | 212 | 256 | 297 | 341 | 384 | 426 |
| 0.08 | 39 | 79 | 119 | 157 | 196 | 236 | 275 | 314 | 354 | 394 |
| 0.10 | 36 | 73 | 109 | 145 | 181 | 218 | 253 | 290 | 327 | 363 |
| 0.12 | 33 | 67 | 101 | 134 | 167 | 201 | 234 | 268 | 302 | 335 |
| 0.14 | 31 | 62 | 93 | 123 | 154 | 186 | 216 | 247 | 279 | 310 |
| 0.16 | 29 | 57 | 86 | 114 | 142 | 171 | 199 | 228 | 258 | 286 |
| 0.18 | 26 | 53 | 79 | 105 | 132 | 158 | 184 | 211 | 238 | 264 |
| 0.20 | 24 | 49 | 73 | 97 | 121 | 146 | 170 | 194 | 219 | 244 |
| 0.22 | 22 | 45 | | | | | | | 202 | 225 |
| 5.04 | 0 | 0 | 0 | 0 | 0 | 0 | 0 | 0 | 1 | |
| 5.06 | 0 | 0 | 0 | 0 | 0 | 0 | 0 | 0 | 0 | 1 |
| 5.08 | 0 | 0 | 0 | 0 | 0 | 0 | 0 | 0 | 0 | 1 |
| 5.10 | 0 | 0 | 0 | 0 | 0 | 0 | 0 | 0 | 0 | 1 |
| 5.12 | 0 | 0 | 0 | 0 | 0 | 0 | 0 | 0 | 0 | 0 |

RECORDING APPARATUS HAVING THERMAL HEAD AND RECORDING METHOD

BACKGROUND OF THE INVENTION

1. Field of the Invention

The present invention relates to a recording apparatus and a recording method which can set a drive condition of a recording head which records by using heat, particularly a recording head which discharges ink by using heat, and a recording method.

2. Related Background Art

Among recording apparatuses which record by using heat are included recording apparatuses of a thermo-sensitive type, a thermal transfer type and an ink jet type. Of those, the ink jet type recording apparatus comprises, in many cases, a semi-permanently usable head (hereinafter referred to as a PH) and a replaceable ink cartridge for supplying ink to the PH. However, in the PH, it is difficult to perfectly eliminate a failure due to aging and a special maintenance service system is required to maintain a recording performance over an extended period.

From a standpoint of improving the reliability, an ink jet type recording apparatus which uses a replaceable head cartridge having integrated ink tank and head (hereinafter referred to as a DH) has been put into practice. Further, an ink tank/head separable and replaceable ink jet type recording apparatus in which the head and the ink tank are independently replaceable with the consideration to a running cost and a global environment while taking the advantage of the DH in terms of the reliability, has also been proposed.

On the other hand, in the drive of the ink jet recording apparatus, a temperature of the ink is critical. Thus, an invention which allows correct detection of the ink temperature by considering a thermal time constant of the head in detecting the ink temperature has been proposed by the assignee of the present invention in U.S. Ser. No. 921,832 (which Japanese Patent Laid-Open Appln. No. 5-31906 corresponds to).

However, in the head replaceable type recording apparatus such as the DH type or the ink tank/head separable and replaceable type in which a plurality of heads are sequentially replaced for one recording apparatus, a drive condition may vary due to a variation in the manufacture of the recording head or the recording apparatus. This may lead to the deterioration of the recording characteristic and the reduction of the thermal lifetime of the recording head and it is a serious problem to be solved.

In order to avoid such a problem, for the variation of the power supply voltage of the recording apparatus, the adjustment of the power supply voltage and the correction of the drive condition in accordance with the measurement of the power supply voltage are carried out at the time of the manufacture of the recording apparatus. For the variation in the manufacture of the replacing head, a standard drive condition in the recording apparatus is previously measured and it is held by the recording apparatus as the drive condition information, and the information is read when the replaceable recording head is mounted in the recording apparatus. As a form of the drive condition information, an identification resistor, electrical storage means such as a ROM or mechanical means such as a notch may be used, and read means therefor is provided in the recording apparatus.

However, the adjustment and the correction of the power supply voltage cause the increase of the manufacturing cost of the recording apparatus. The measurement of the drive condition of the replaceable head at the time of shipment increases the cost of the replaceable head and requires dedicated read means in the recording apparatus. Thus, in the prior art apparatus, the construction is complicated and this poses a serious problem for the replaceable head type recording apparatus.

SUMMARY OF THE INVENTION

It is an object of the present invention to provide recording apparatus and recording method which permit the stabilization of the recording character- istic.

It is another object of the present invention to provide recording apparatus and recording method which solve the variation factors of the power supply voltage of the recording apparatus and the recording head mounted thereon and which are simple in construction.

In order to achieve the above objects, the present invention provides a recording apparatus having a recording head mounted thereon for recording by using thermal energy, comprising:

heat means for driving and heating said mounted recording head;

detection means for detecting a thermal change state of said recording head heated by said heat means to determine a thermal characteristic of said recording head;

set means for setting a driving condition of said mounted recording head in accordance with the thermal change state detected by said detection means; and drive means for driving said recording head in accordance with the driving condition set by said set means.

The present invention further provides a recording apparatus having a recording head mounted thereon for discharging ink by energizing a heat generating element, comprising:

heat generation means for energizing the heat generating element of said mounted recording head;

detection means for detecting a thermal change state of said recording head heated by said heat generation means to determine a thermal characteristic of said recording head;

set means for setting a driving condition for energization for recording of the heat generation element of said mounted recording head in accordance with the thermal change state detected by said detection means; and drive means for driving the heat generation element of said recording head for recording in accordance with the driving condition set by said set means.

The present invention further provides a recording apparatus having a recording head mounted thereon for recording by using thermal energy, comprising:

estimation means for estimating a temperature of said recording head in accordance with a drive duty of said mounted recording head based on a predetermined thermal characteristic;

detection means for detecting a temperature of said recording head;

determination means for determining the thermal characteristic of said recording head based on a difference between the outputs of said estimation means and said detection means;

set means for setting a driving condition of said mounted recording head in accordance with the thermal characteristic detected by said determination means; and drive means for driving said recording head in accordance with the driving condition set by said set means.

The present invention further provides a method for recording by a recording head by using thermal energy, comprising the steps of:

measuring a first temperature of said recording head;

heating said recording head by energizing said recording head;

measuring a second temperature of said recording head after the start of heating;

detecting a thermal characteristic of said recording head based on the measures first and second temperatures of said recording head;

setting a driving condition of said recording head in accordance with the detected thermal characteristic; and energizing said recording head for recording in accordance with the set driving condition.

The present invention further provides an ink jet recording apparatus having a replaceable thermal head mounted thereon, comprising:

thermal characteristic determination means for determining a thermal change state of said thermal head by energizing said thermal head; and set means for setting a driving condition of said thermal head in accordance with the thermal change state determined by said determination means.

BRIEF DESCRIPTION OF THE DRAWINGS

FIG. 8 shows a self-setting table for a drive condition in the embodiment 1 of the present invention, FIGS. 14A, 14B and 14C show the setting of the drive condition in the embodiment 5, FIG. 17 shows a setting table for the drive condition in accordance with the heat dissipation characteristic, and FIG. 18 shows a temperature falling table relating to the temperature estimation of the recording head in an embodiment 7 of the present invention.

DETAILED DESCRIPTION OF THE PREFERRED EMBODIMENTS

The preferred embodiments of the present invention will now be explained in detail in conjunction with the accompanying drawings.

Figure 1:
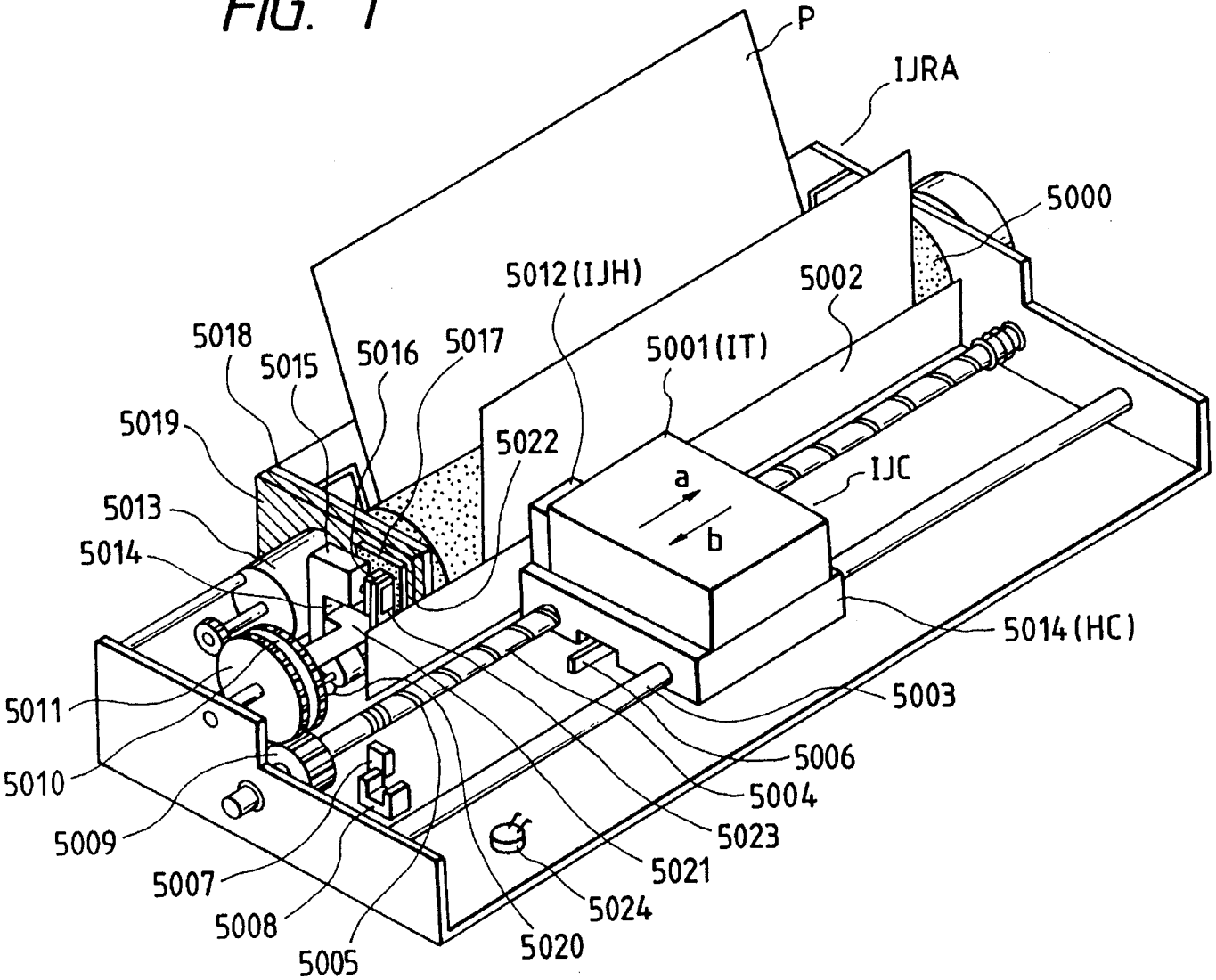
FIG. 1 shows a head replaceable ink jet recording apparatus which may be applied to the present invention.

FIG. 1 shows a head replaceable ink jet type recording apparatus to which the present invention may be applied. In FIG. 1, numeral 5001 denotes an ink tank and numeral 5012 denotes a recording head coupled thereto. The ink tank 5001 and the recording head 5012 are integrally constructed to form a replaceable ink jet cartridge (IJC). Numeral 5014 denotes a carriage for supporting the IJC to a printer body to conduct the record scan. It is reciprocally driven along a guide 5003 in directions a and b as a lead screw 5005 is rotated. A pin (not shown) of the carriage 5014 is engaged with a spiral groove 5005 of the lead screw 5004 which is rotated through driving force transmission gears 5011 and 5009 as a drive motor 5013 is fowardly and reversely rotated. Numeral 5000 denotes a platen roller which transports a print sheet P in a predetermined width. The print sheet is pressed by a sheet retainer 5002 over a drive direction of the carriage. Numerals 5007 and 5008 denote home position detection means for detecting the presence of a lever 5006 of the carriage 5014 by a photo-coupler to control the rotation of the motor 5013. Numeral 5016 denotes a member for supporting a cap member 5022 which caps a discharge port defining plane of the recording head, and numeral 5015 denotes suction means for creating a suction pressure in the cap to recover the recording head 5012 through an opening 5023 of the cap. Numeral 5017 denotes a cleaning blade which is attached to a member 5019 which is forwardly and rearwardly movably supported to a main body support plate 5018 and it wipes the discharge port defining plane of the recording head as required. Numeral 5021 denotes a lever for initiating the suction operation of the suction recovery and it is driven as a cam 5020 which engages with the carriage 5014 is driven so that a driving force from the drive motor is controlled by known transmission means such as clutch means. The capping, the cleaning and the suction recovery are conducted at the respective corresponding positions by the action of the lead screw 5005 when the carriage 5014 reaches a home position area.

Numeral 5024 denotes a temperature sensor for measuring an environment temperature in the apparatus and it comprises a chip thermistor arranged on an electric packaging board of the recording apparatus. In the carriage 5014, a flexible cable (not shown) for supplying a driving signal pulse current and a head temperature adjusting current to the recording head 5012 is connected to a printed circuit board (not shown) for controlling the printer. When the recording head is mounted on the carriage, they are electrically connected.

Figure 2:
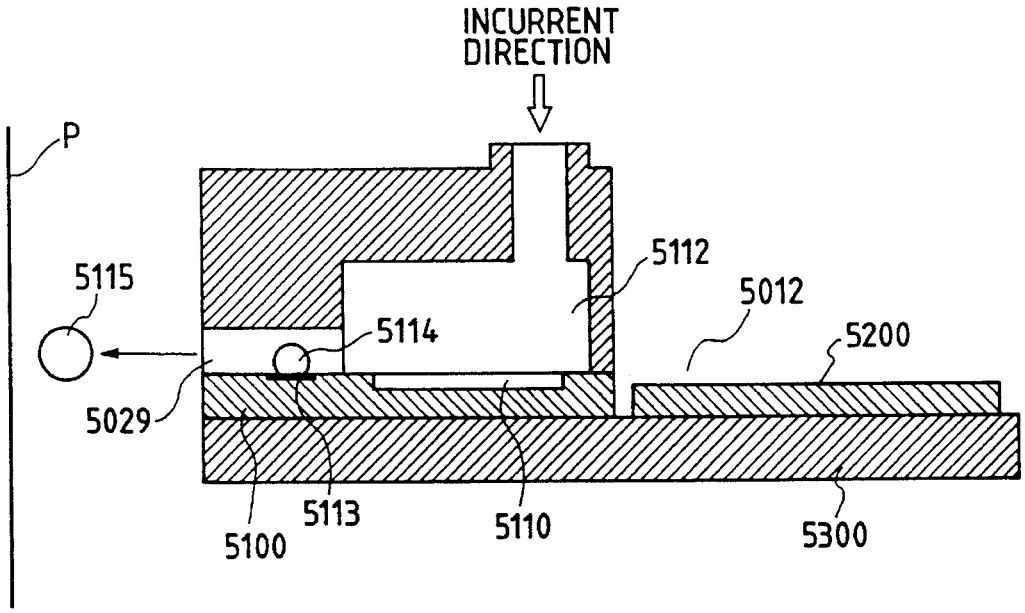
FIG. 2 shows a construction of a thermal ink jet recording head.

FIG. 2 shows a construction of the recording head 5012. A heater board 5100 formed by a semiconductor manufacturing process is arranged on a support 5300. A discharging heat 5113 for discharging ink, a temperature adjusting heater 5110 for maintaining and adjusting the energized recording head as required and a temperature detecting resistor 5111 (not shown) for detecting the temperature of the recording head, which are manufactured by the same semiconductor manufacturing process, are arranged on the heater board 5100. Numeral 5200 denotes a wiring board arranged on the support 5300. It is connected to the electrical elements by wire bonding (wiring not shown) and the wiring board and the board on the carriage are connected to conduct the electrical connection of the recording head. The discharging heater 5113 is energized to generate bubbles 5114 in the nozzle so that ink droplets 5115 are discharged to make a record on the print sheet P. Numeral 5112 denotes a common liquid chamber in which the ink from the ink tank formed integrally with the recording head flows.

Figure 3:
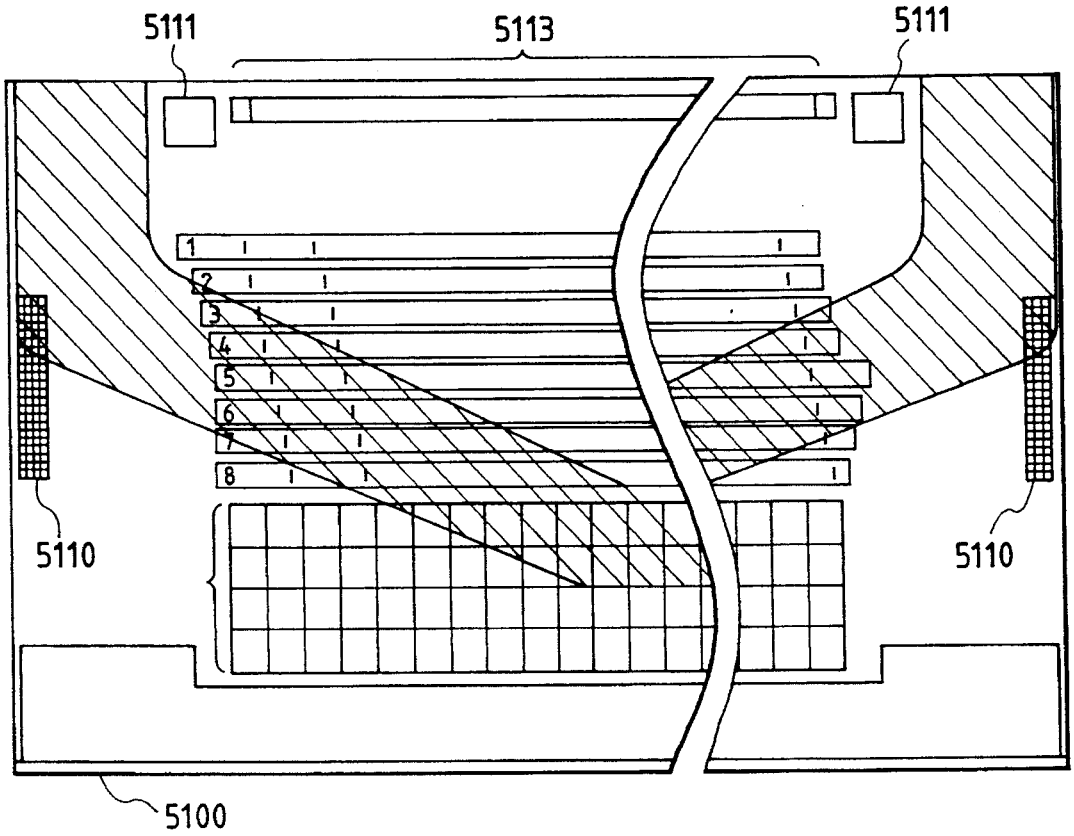
FIG. 3 shows a construction of an HB of the thermal ink jet recording head.

As shown in FIG. 3, the heater board 5100 comprises a plurality of electro-thermal transducing elements (discharging heaters) 5113 arranged in line on an Si substrate, temperature detecting resistors 5111 arranged on the opposite sides thereof, temperature adjusting heaters 5110 arranged slightly spaced therefrom, and electric wires such as A1 wires for supplying electric power to those elements which are formed by film forming technique. It is connected to the wiring board having pads for receiving the electrical signals from the apparatus main body, arranged at the edges, by the wire bonding for the corresponding wires. By arranging the respective elements on one board, the head temperature detection and the temperature adjustment are conducted efficiently and the compactness of the head and the simplification of the manufacturing process are attained. It is suitable for the present embodiment of the replaceable head. Partitions for defining a plurality of ink flow paths for the respective discharge heaters, a common liquid chamber for receiving the ink from the ink tank through the flow paths and supplying the ink to the ink paths, and orifices forming a plurality of discharge ports are integrally formed in a grooved top plate by polysulfon, and it is pressed to the heater board by a spring, not shown, and it is further press-contacted, fixed and sealed by sealing agent to form the ink discharge unit. The flow paths coupled and sealed to the grooved top plate have a filter arranged at the end coupled to the ink tank for preventing dusts and unintended bubbles from flowing into the discharge ports. A head cover is provided to protect the discharge ports of the recording head and the electric connecting pads and to facilitate the handling of the recording head.

In the replaceable ink tank, ink absorbers having ink impregnated therein are filled in the tank case having ribs therein, without space.

In the present embodiment, a pair of electrode pins are inserted as a remaining ink sensor in the vicinity of the ink supply unit of the ink tank so that the decrease of the remaining ink is detected by using the fact that a resistor between the electrodes increases when the remaining ink in the absorber decreases.

Figure 4:
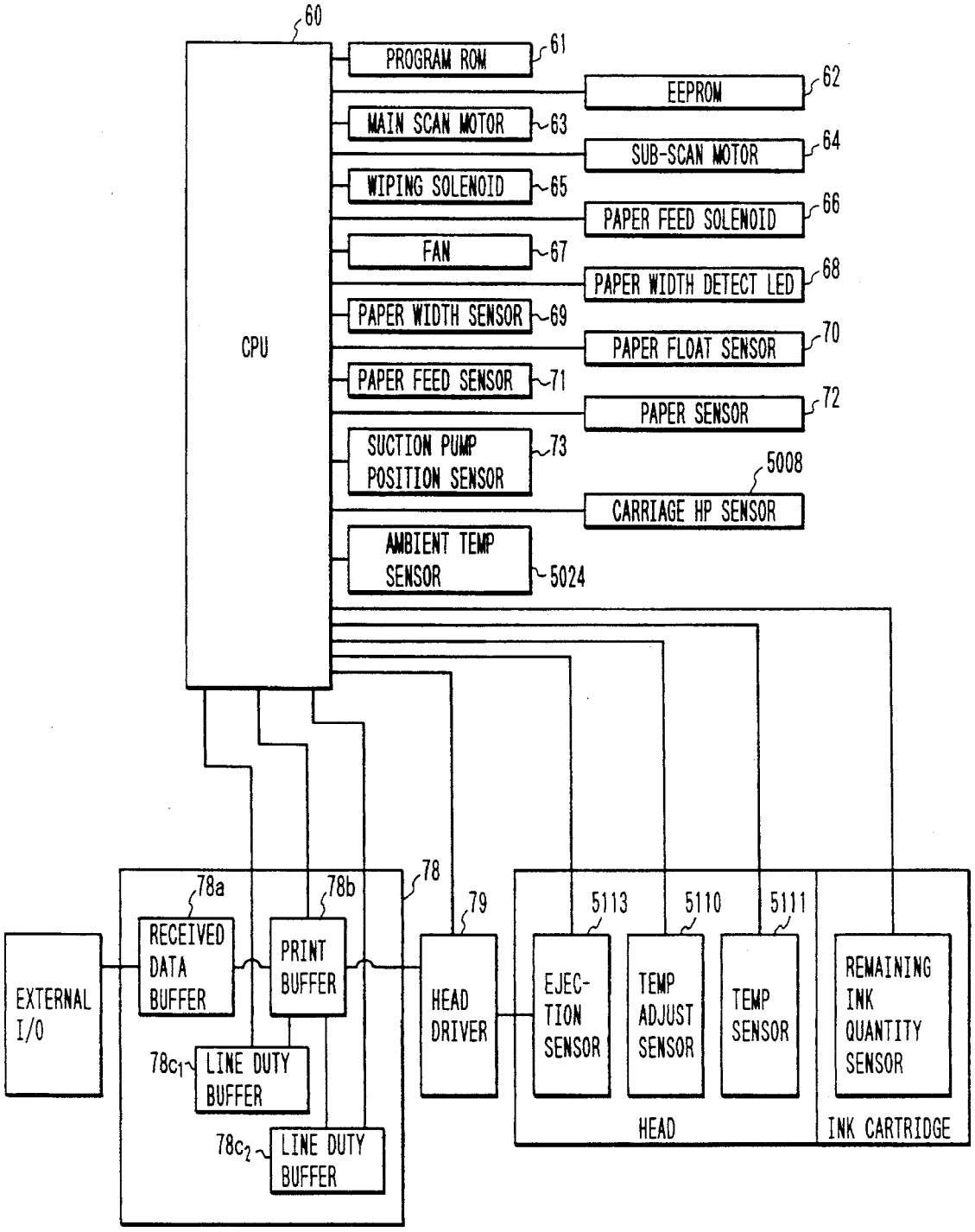
FIG. 4 shows a control configuration of a thermal ink jet recording apparatus.

Referring to FIG. 4, a control unit for controlling the respective elements of the apparatus is now explained. In FIG. 4, numeral 60 denotes a CPU, numeral 61 denotes a program ROM which stores a control program to be executed by the CPU 60, and numeral 62 denotes an EEPROM which stores data for recording. Numeral 63 denotes a main scan motor for transporting a recording head, and numeral 64 denotes a sub-scan motor for transporting a record sheet. It is also used for a suction operation. Numeral 65 denotes a wiping solenoid, numeral 66 denotes a sheet feed solenoid used to control the sheet feed, numeral 67 denotes a cooling fan and numeral 68 denotes a sheet width detecting LED. Numeral 69 denotes a sheet width sensor, numeral 70 denotes a sheet floating sensor, numeral 71 denotes a sheet feed sensor, numeral 72 denotes a sheet ejection sensor and numeral 73 denotes a suction pump position sensor for detecting a position of the suction pump. Numeral 5008 denotes a carriage HP sensor for detecting a home position of the carriage and numeral 5024 denotes an environment temperature sensor. Numeral 78 denotes a gate array for controlling the supply of the recording data to the recording head and numeral 79 denotes a head driver for driving the head.

Figure 5:
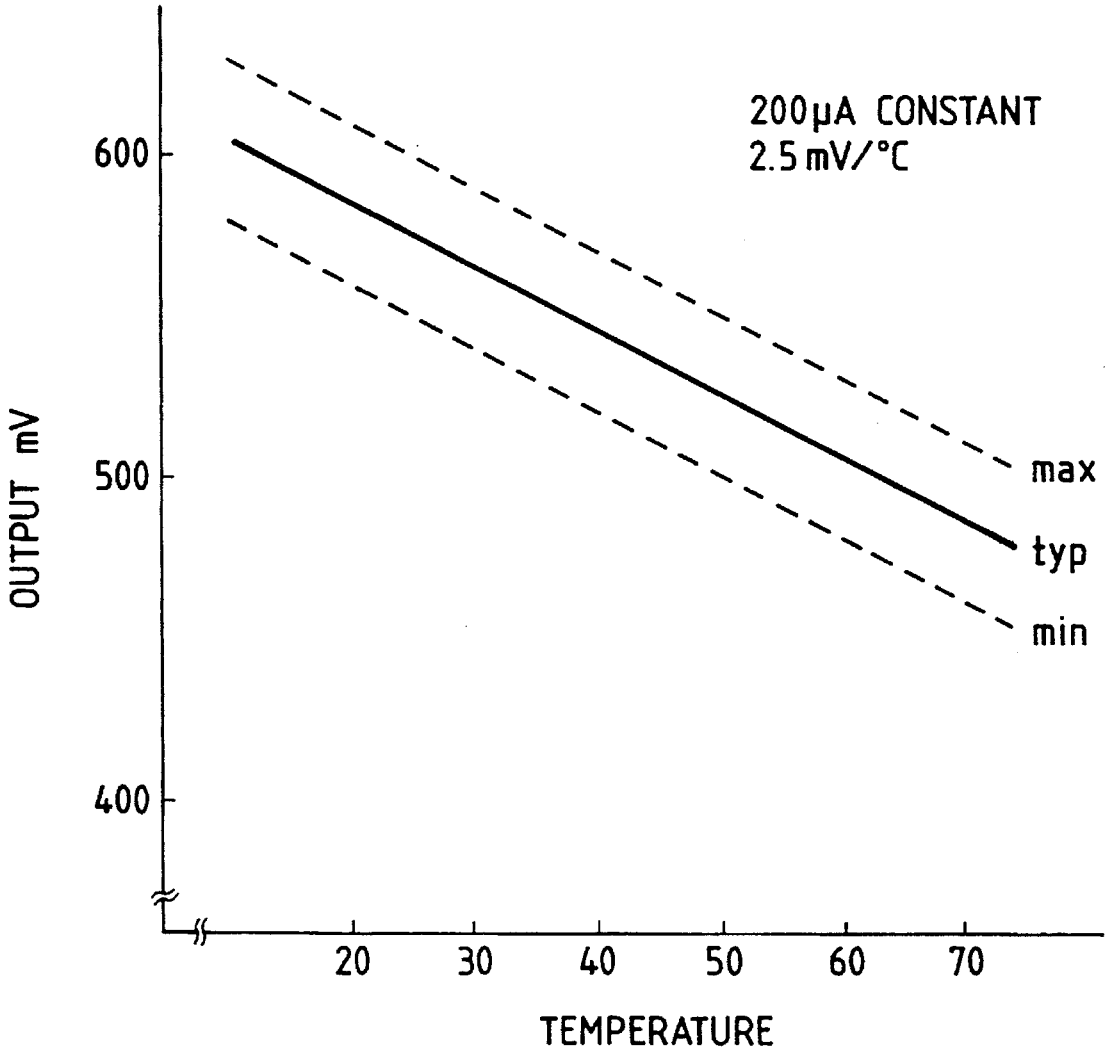
FIG. 5 shows a characteristic of a temperature sensor of the thermal ink jet recording head.

A resistor for detecting the temperature in the present embodiment is formed on the heater board as a diode configuration and a temperature characteristic thereof is shown in FIG. 5. In the present embodiment, the constant current drive at 200 μA is effected to exhibit an output characteristic having a temperature dependency of approximately −2.5 mV/° C. at an output voltage VF of 575±25 mV. In the manufacture of the element, the variation of the temperature dependency is small but the deviation of the output voltage is as large as approximately 25° C.

It is possible to reduce the variation of the temperature detecting element in the manufacture process but it is not preferable from the standpoint of manufacturing cost. At the time of shipment of the recording head, the correction value of the output voltage of the temperature detecting element may be measured, the information may be maintained in the recording head and the information may be read by the recording apparatus, but it is again not preferable for the replaceable recording head in terms of the manufacturing cost.

In the present embodiment, the environment temperature sensor arranged on the recording apparatus is used to calibrate the temperature detecting element of the recording head. Namely, when the temperature of the recording head is stable and substantially equal to the environment temperature in the recording apparatus, a difference between the temperature of the recording head temperature sensor 5111 and the temperature of the environment temperature sensor 5024 is stored in the EEPROM as a correction value, and in the record mode, the CPU reads the correction value to correct the actual detected temperature for control.

A method for self-setting the drive condition of the recording head which is a feature of the present invention is now explained in detail. In the recording head of the present embodiment which uses the electro-thermal transducer (discharging heater 5113) to discharge the ink, a predetermined electrical energy is supplied to the discharging heater 5113 in the record mode to heat the ink at the nozzle to generate the bubbles. The heating of the predetermined energy is required to generate the bubbles, and the heat generated varies by the variation of the resistance due to the variation in the manufacture of the discharging heater. Further, the heat generated varies by the variation in the ON/OFF characteristic of the head driver of the recording apparatus and the drive voltage. In this manner, the heat generated when the recording head is driven varies by the combination of the recording head and the recording apparatus. When the energy supplied to the discharging heater is small, the bubbles are not sufficiently grown and the ink is not discharged well, and when it is too large, the thermal deterioration of the discharging heater progresses and the durability is lowered, which leads to the reduction of the lifetime of the recording head.

Figure 6:
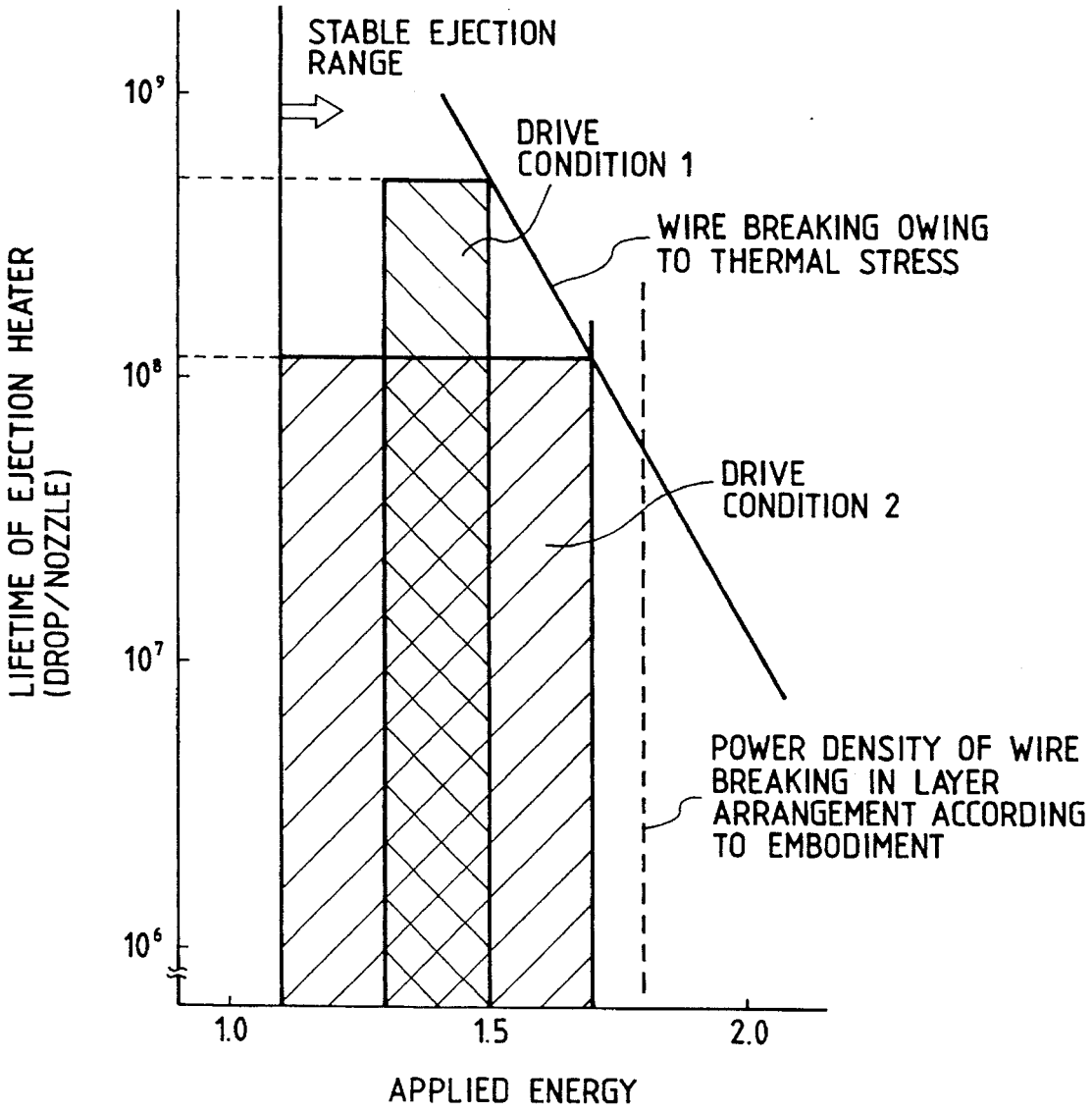
FIG. 6 shows a correlation between a recording energy of a thermal recording head and a lifetime of a head HB film.

FIG. 6 shows a relation between the stable discharge range of the recording head and the lifetime. In FIG. 6, a value K represents. a minimum dischargeable energy. In order to conduct the stable discharge without decrease of the discharge and twist, an energy of at least 1.1 times as large as the value K is usually required. On the other hand, when the energy exceeding K times 1.7 is supplied, the thermal deterioration of the discharging heater rapidly proceeds, which leads to the reduction of the head lifetime. Accordingly, it is preferable to drive the recording head between 1.1K and 1.7K (a drive condition 2). More preferably, it is driven between 1.3K and 1.5K (a drive condition 1). In the present embodiment, the drive voltage of the recording apparatus is fixed and the width of the drive pulse is varied in accordance with the recording head. Thus, it may be designed to drive the head between 1.1 times and 1.7 times of the minimum dischargeable pulse width by referring to FIG. 6.

The above variation may be reduced to a practically acceptable level by the improvement of the manufacturing process of the recording head and the recording apparatus, but it is not practical from the standpoint of the cost and it is a serious problem in the head replaceable type.

In accordance with the present invention, the drive condition of the recording head is set in accordance with the heat generation characteristic of the discharging heater based on the fact that the heat generated by the discharging heater directly acts on the discharge of the ink. Further, since the variation of the power supply voltage of the recording apparatus and the variation of the ON/OFF characteristic (particularly the rise/fall characteristic of the drive voltage) can be comprehensively corrected, the drive condition may be set accurately.

(Embodiment 1)

In the present embodiment, the measurement of the thermal characteristic of the recording head and the setting of the drive condition based on the characteristic are done by measuring the temperature rise width of the recording head when the energy of the predetermined frequency and drive pulse width is supplied to the discharging heater and determining the reference drive pulse width by referring to the drive condition setting table stored in the ROM in accordance with the temperature rise width. The drive condition is set in accordance with the predetermined replacement done by the user when the recording head is replaced. Namely, it is done when suction recovery operation which is necessary in replacing the recording head is designated. It is executed while the temperature of the recording head is stable after the replacement and the condition is stored in the EEPROM.

Figure 7:
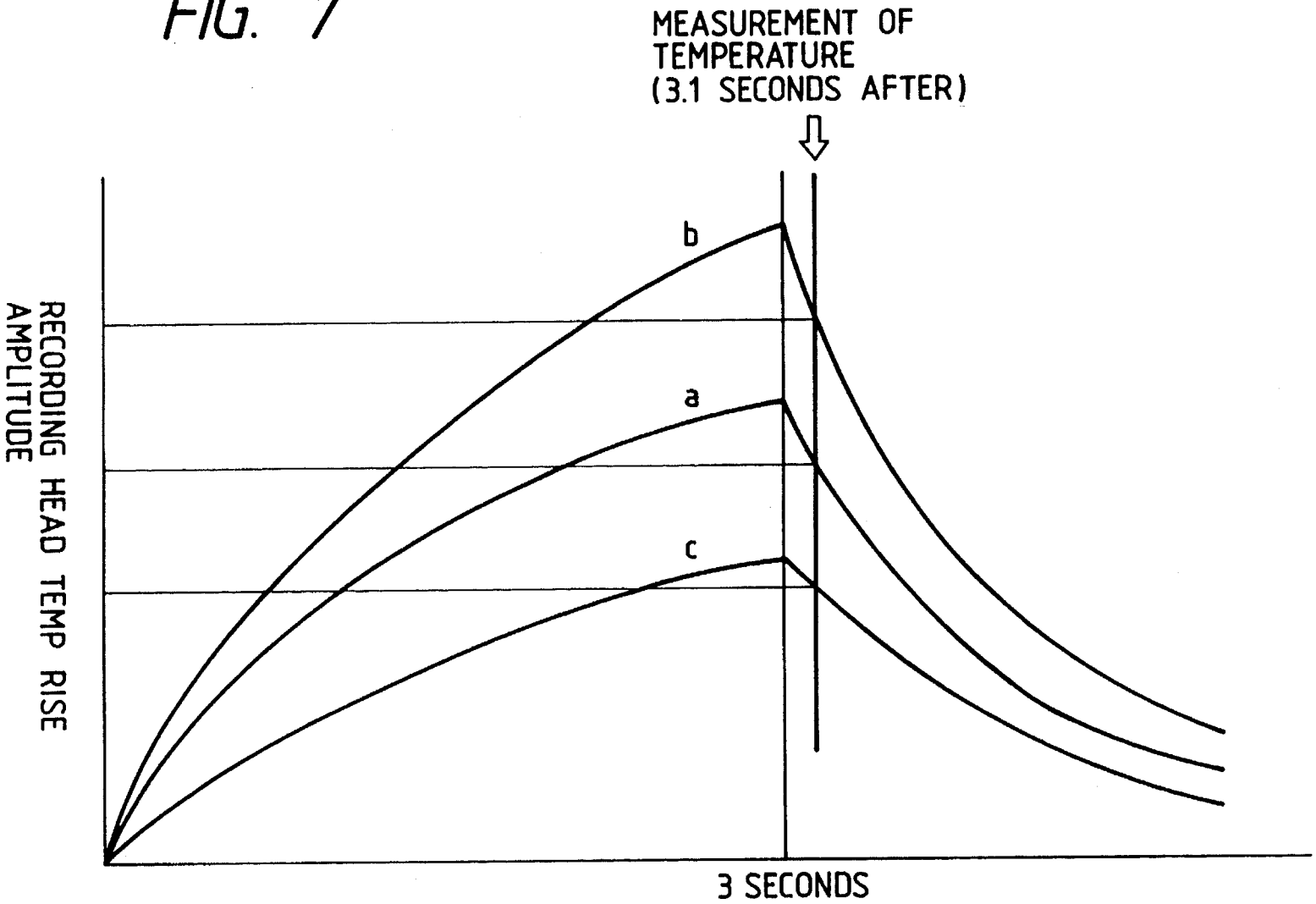
FIG. 7 shows the measurement of a thermal characteristic in an embodiment 1.

FIG. 7 shows the change in the temperature of the recording head in the present embodiment when an energy of a level which does not generate the bubbles, for example, a pulse width of 1 μsec is applied to the discharging heater for three seconds. In FIG. 7, a solid line a shows a change of the temperature when a standard recording head is used in a standard recording apparatus. Namely, it shows the temperature change derived from a combination of a recording head having averages of size and the film thickness of the discharging heater and a recording apparatus having an average variation of the heat generation characteristic of the wiring resistance in the recording head. Solid lines b and c show temperature changes of the upper limit combination and the lower limit combination, respectively, of the heat generation characteristic of the recording head and the characteristic of the recording apparatus.

In the present embodiment, in order to prevent a noise in driving the discharging heater from being introduced in the measurement of the temperature, the temperature rise width is measured immediately before the heating and 0.1 second after the interruption of the heating. Where the affect by the noise in measuring the temperature is low, the temperature rise width may be measured during the heating or immediately after the interruption of the heating. In the present embodiment, the temperature rise width is measured by driving by the pulse width which does not cause to generate the bubbles in order to eliminate the variation of the heat dissipation characteristic due to the ink discharge, although the temperature rise width may be measured under the actual discharging drive condition with the bubbles being generated if the variation of the discharged ink droplets is small. In this case, it also functions as a preliminary discharge operation.

FIG. 8 shows a drive condition setting table for determining a reference drive pulse width of the recording head in accordance with the temperature rise width of 0.1 second after the interruption of the heating. When the temperature rise width is lower or higher than the predetermined width, it is regarded that the recording head is in error and the measurement is made again. Since the error in the temperature rise width may be caused by the lack of ink in the recording head, the initialization of the recording head such as the suction recovery operation of the recording head may be conducted prior to the remeasurement.

In the present embodiment, the recording head drive voltage of the recording apparatus is fixed as the drive condition for the recording head and the thermal characteristic is measured while the recording head and the recording apparatus are combined to optimize the reference drive pulse width, although the drive pulse width may be fixed and the recording head drive voltage may be changed.

In the present embodiment, a monochromatic recording apparatus having one recording head has been described although the present invention is applicable to a color ink jet recording apparatus having a plurality of recording heads for discharging inks of different colors, for example, four heads for Bk, C, M and Y. In this case, the drive condition may be set to the respective recording heads either sequentially or simultaneously. Further, the present invention is also applicable to a recording head which can discharge inks of different colors. In this case, the drive condition may be set serially for the respective colors of the recording head, or one drive condition may be set assuming that the heat generation characteristics and the drive conditions are substantially identical because it is manufactured simultaneously under the same manufacturing condition.

In the present embodiment, in order to determine the basic drive condition of the recording head, the recording head is driven under the substantially same condition as the recording condition and the heat generation characteristic of the combination of the recording head and the recording apparatus is directly measured to set the pulse width. Accordingly, even if the variation is included in the recording head and the recording apparatus, an optimum drive condition may be derived.

(Embodiment 2)

As the recording head is implemented by a multi-nozzle head, the nozzles on one recording head are divided into a number of groups (blocks) which are sequentially energized. In such a block drive system, the number of nozzles to be simultaneously driven may be reduced to avoid the large size of the recording head driving power supply of the recording apparatus. The present embodiment is applicable to such a multi-nozzle head.

In accordance with the number of discharging heaters to be simultaneously driven, the voltage drops in the recording head, in the flexible cable connecting the recording head and the recording apparatus and in the head driver in the recording head may change and the current flowing through the discharging heater of the recording head may change. The print signal is not always transferred to the recording head at a fixed duty, but it may be at an upper limit of the lines allocated to the block or it may be only one line depending on the image. Thus, the number of nozzles to be simultaneously driven varies within the number of nozzles in the block. The current actually which flows through the discharging heater also varies by the change of the number of nozzles to be simultaneously driven. The energy level K is required, as described above, as the minimum energy for the discharge, and the capacity of the power supply may be set by considering the reduction of energy when the number of nozzles to be simultaneously driven is maximum.

However, the increase of the capacity of the power supply directly leads to the increase of size of the power supply and the cost, and the design is made, in many cases, by assuming certain amount of voltage drop by the restriction of those problems. In this case, when the number of nozzles to be simultaneously driven is small, an excessive energy is supplied to the discharging heater and the lifetime of the heater is reduced.

In the present embodiment, the drive condition is set in accordance with the number of nozzles to be simultaneously driven. In the present embodiment, the number of nozzles to be simultaneously driven is 8 at maximum and the reference drive pulse width is changed between a case where three or more nozzles are simultaneously driven and a case where no more than three nozzles are simultaneously driven, and the reference drive pulse width for each case is set based on the measurement of the thermal characteristic for the two-nozzle drive and the measurement of the thermal characteristic for the eight-nozzle drive.

Figure 9:
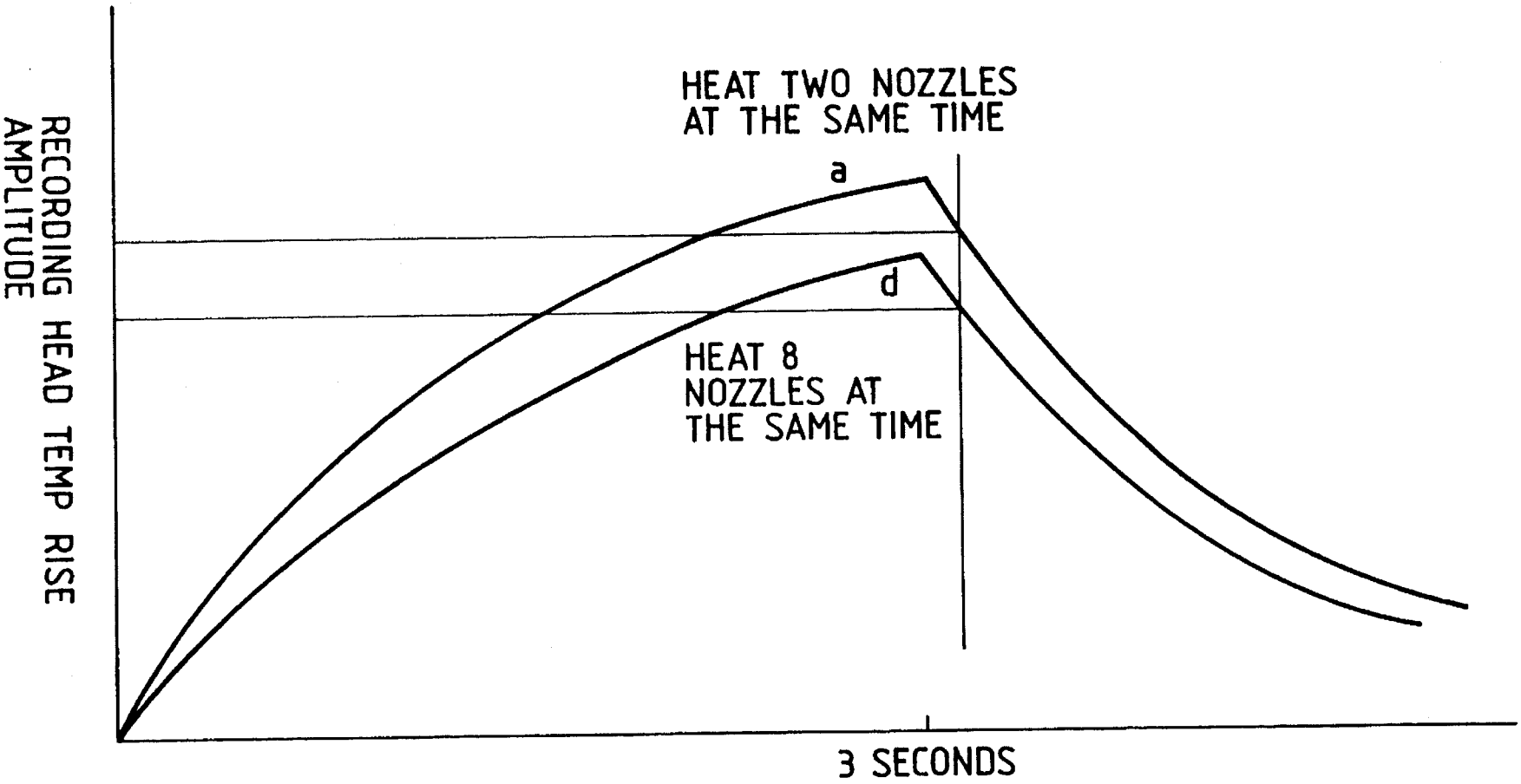
FIG. 9 shows the measurement of the thermal characteristic in an embodiment 2 of the present invention.

The drive condition setting table is same as that shown in FIG. 2, and the drive frequency and the drive nozzle pattern are adjusted in the measurement of the thermal characteristic to attain the same heat generation (average drive duty) as that of the embodiment 1, and the temperature rise widths for the two-nozzle simultaneous drive and the eight-nozzle simultaneous drive are separately measured and separate reference pulse widths are set. For example, 64 nozzles are divided into 8 nozzles ×8 blocks, and when all nozzles are to be energized 9600 times in three seconds with the pulse width of 1 μsec, the energization of two nozzles at a time by 4800 times and the energization of eight nozzles at a time by 1200 times are conducted separately and the temperature rise widths are measured. Since the temperature rise width in the eight-nozzle simultaneous drive is less affected by the voltage drop (FIG. 9) as described above, when the reference drive pulse width is set by using the table of FIG. 8, it is set to a slightly higher reference pulse width than that for the two-nozzle simultaneous drive. In the actual printing, the number of nozzles to be simultaneously driven is determined by a duty buffer in the gate array 78 shown in FIG. 4 to drive at the reference drive pulse width which is optimum to the head driver.

In the present embodiment, the affect by the voltage drop due to the difference of the number of nozzles to be simultaneously driven is reduced. Where the precision of the thermal characteristic measurement is high, the thermal characteristic may be measured for all (1 to 8) of the nozzles to be simultaneously driven and separate reference drive pulses may be set in order to attain high precision of the drive condition.

(Embodiment 3)

In the embodiment 1, the drive condition of the recording head is set at the time of replacement of the head. In the present embodiment, the drive condition is automatically set at a predetermined timing so that it may comply with a case where storage means such as the EEPROM is not provided in the recording apparatus or a case where a special operation is not required in the replacement of the recording head and an appropriate set timing cannot be set.

Figure 10:
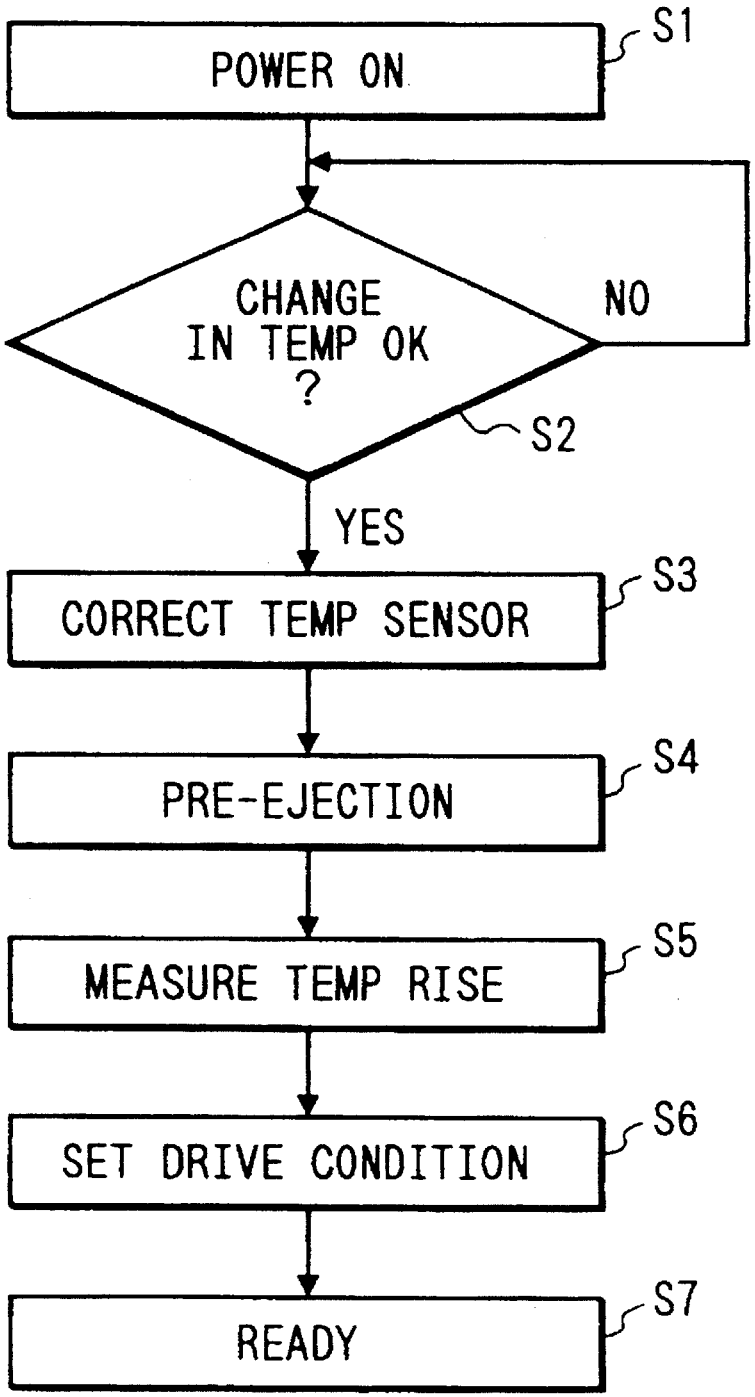
FIG. 10 shows a flow chart of automatic setting of the drive condition in an embodiment 3.

As shown in a flow chart of FIG. 10, in the present embodiment, the drive condition is set at the time of power-on of the recording apparatus. Since the drive condition is set in accordance with the measurement of the thermal characteristic of the recording head in the present invention, it is preferable to measure the thermal characteristic when the recording head is thermally stable. Further, since the correction of the temperature sensor of the recording head necessary for the measurement of the thermal characteristic is made by the recording apparatus, it is also preferable that the recording head is thermally stable prior to the setting of the drive condition from the standpoint of the correction of the temperature sensor.

Accordingly, in the present embodiment, before the correction of the temperature sensor (step S3) prior to the setting of the drive condition (step S6) after the power-on (step S1), the temperature change rate of the recording head is first measured (step S2). As described above, the temperature sensor used in the present embodiment has a large variation in the output voltage but a small variation in the temperature dependency. Thus, the change in the temperature within a predetermined time period can be detected even before the correction of the temperature sensor. Accordingly, if the change is below a predetermined level, the correction of the temperature sensor and the setting of the drive condition are conducted. The drive condition is set (step S6) after the predischarge is made and an energy is supplied to the heater in a step S4 and the temperature rise width is measured in a step S5 to measure the thermal characteristic of the recording head. Thereafter, the apparatus is we a ready state (ready to record) in a step S7.

(Embodiment 4)

Figure 11:
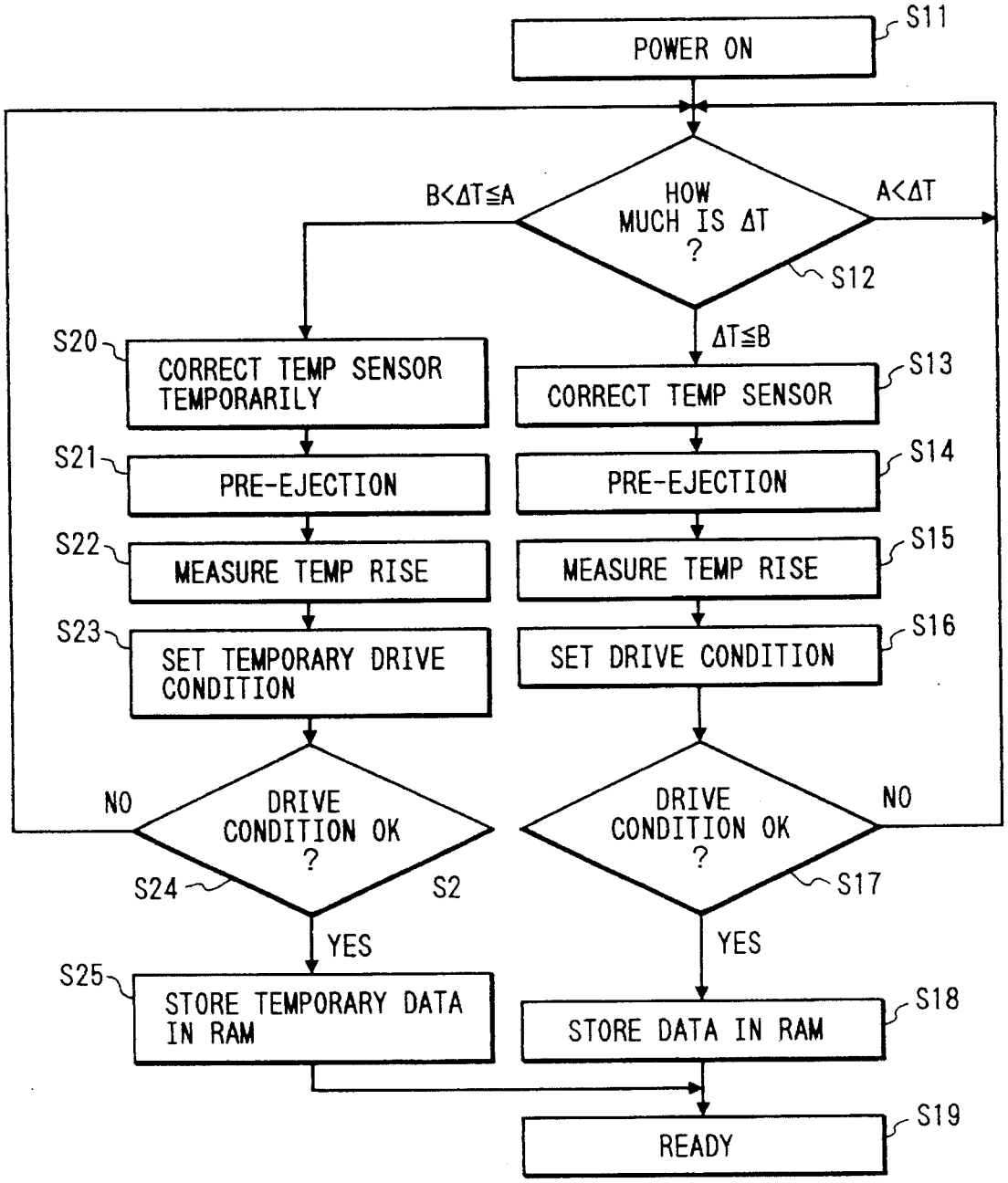
FIG. 11 shows a flow chart of a modification of the self-setting of the drive condition in an embodiment 4.

In the present embodiment, as shown in a flow chart of FIG. 11, two steps of thermal stability (temperature change) of the recording head are prepared, and if the change is slightly larger than that which is preferable, the correction of the temperature sensor and the setting of the drive condition are temporarily made, and after the temperature change of the recording head becomes smaller than the desired one, the correction of the temperature sensor and the setting of the drive condition are retried. By so doing, the recording apparatus may be operated by using the temporary correction value even if the recording head is not thermally stable immediately after the power-on of the recording apparatus. Since the temperature rise width necessary for the correction of the thermal characteristic of the recording head may be detected even if the correction of the temperature sensor is not sufficient as described above, the error in driving with the temporary value is due to the difference in the heat dissipation according to the thermal hysteresis of the recording head and the failure of the discharge may be avoided by using the slightly larger pulse width for the temporary value. If the use is for a short period, the affect to the lifetime of the discharge heater will be small.

After the power-on (step S11) in FIG. 11, if the temperature change rate (ΔT) is larger than A in a step S12, the correction of the temperature sensor and the setting of the drive condition are withheld. If the temperature change rate (ΔT) is below B, the temporary correction of the temperature sensor and the temporary setting of the drive condition are made and the preparation for the record operation is temporarily completed (steps S20–S25 and S19), and the detection of the temperature change rate is continued during the non-record mode, and it becomes lower than B, the normal correction and the normal setting are retried.

For the temporary setting of the drive condition, a pulse width which is one step larger than the reference drive pulse width derived by the temperature rise width is set in order to avoid the failure of discharge due to insufficient energy. Alternatively, a temporary drive condition setting table which is different from the setting table shown in FIG. 8 may be used by taking the setting error in the temporary setting into consideration.

In the present embodiment, since the drive condition is set at the power-on of the recording apparatus, the discharge may be attained by a combination of any recording head and any recording apparatus so long as the drive condition in the measurement of the thermal characteristic is set to higher level, for example, 4.50 μsec in FIG. 8 to conduct the actual ink discharge, and it may also function as the pre-discharge operation when the power supply is turned on. As shown in FIG. 11, if the drive condition is abnormal, the retry is made.

In the present embodiment, the flow of setting the drive condition in the absence of the EEPROM has been described. When the drive condition is set at the predetermined timing in the presence of the storage means such as the EEPROM, not only the determination of the upper limit and the lower limit but also the comparison with the previous drive condition stored in the storage means may be conducted in discrimination of driving condition as shown in FIG. 11.

(Embodiment 5)

In the embodiment 1, the drive head is driven by single pulse. In the present embodiment, the drive pulse comprises a plurality of intermittent pulses and the discharging heater is energized in a plurality of time periods to attain a so-called multi-pulse drive which is described in detail in U.S. Ser. No. 821,773 filed on Jan. 16, 1992, now U.S. Ser. No. 08/104,261 filed May 17, 1993. Advantages of the multi-pulse drive are that the discharge velocity is high and the amount of discharge is large because of a large discharging energy and the stabilization of the discharge is attained, and that the change of the amount of discharge by the change of the temperature of the recording head can be suppressed by appropriately changing the drive condition.

Figure 12:
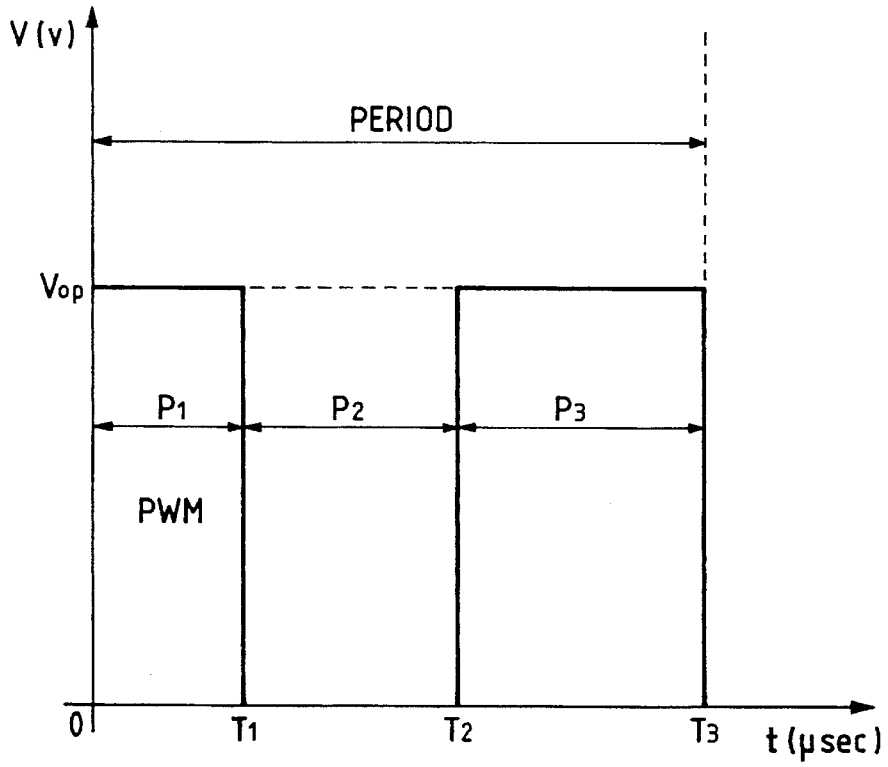
FIG. 12 shows the multi-pulse drive in an embodiment 5.

In the multi-pulse drive used in the present embodiment, the drive pulses are divided into two groups,as shown in FIG. 12 to energize the discharging heater. In FIG. 12, $V_{OP}$ denotes a drive voltage, P1 denotes a pulse width of a first pulse (pre-pulse) of the divided heat pulses, P2 denotes an interval time and P3 denotes a pulse width of a second pulse (main pulse). T1, T2 and T3 denote times to determine P1, P2 and P3, respectively. The PWM discharge amount control of the present embodiment uses a pre-pulse width modulation drive method in which pulses are sequentially applied with the widths of P1, P2 and P3 and the width of the pre-pulse is modulated in accordance with the temperature of the recording head. The pre-pulse is for primarily controlling the temperature of the ink in the vicinity of the discharging heater and it plays an important role of the dischage amount control of the present embodiment. The width of the pre-heat pulse is preferably set to a value which does not cause the bubbles by the thermal energy generated by the electro-thermal transducer to which the pre-heat pulse is applied, and the width P1 is preferably set in accordance with the resistance of the discharging heater which affects the generated heat, which relates to the area, the thickness and the material, the power supply voltage (drive voltage) of the recording apparatus and the fall characteristic of the head driver. The interval time secures the time for the transmission of the thermal energy by the pre-pulse from the discharging heater surface to the neighboring ink. The main pulse causes the bubbles in the ink which contacts the discharging heater and causes the ink to be discharged from the discharging port, and the width P3 is preferably determined in accordance with the resistance of the discharging heater which affects the generated heat, which relates to the area, the thickness and the material, the power supply voltage (drive voltage) of the recording apparatus and the fall characteristic of the head driver.

Figure 13:
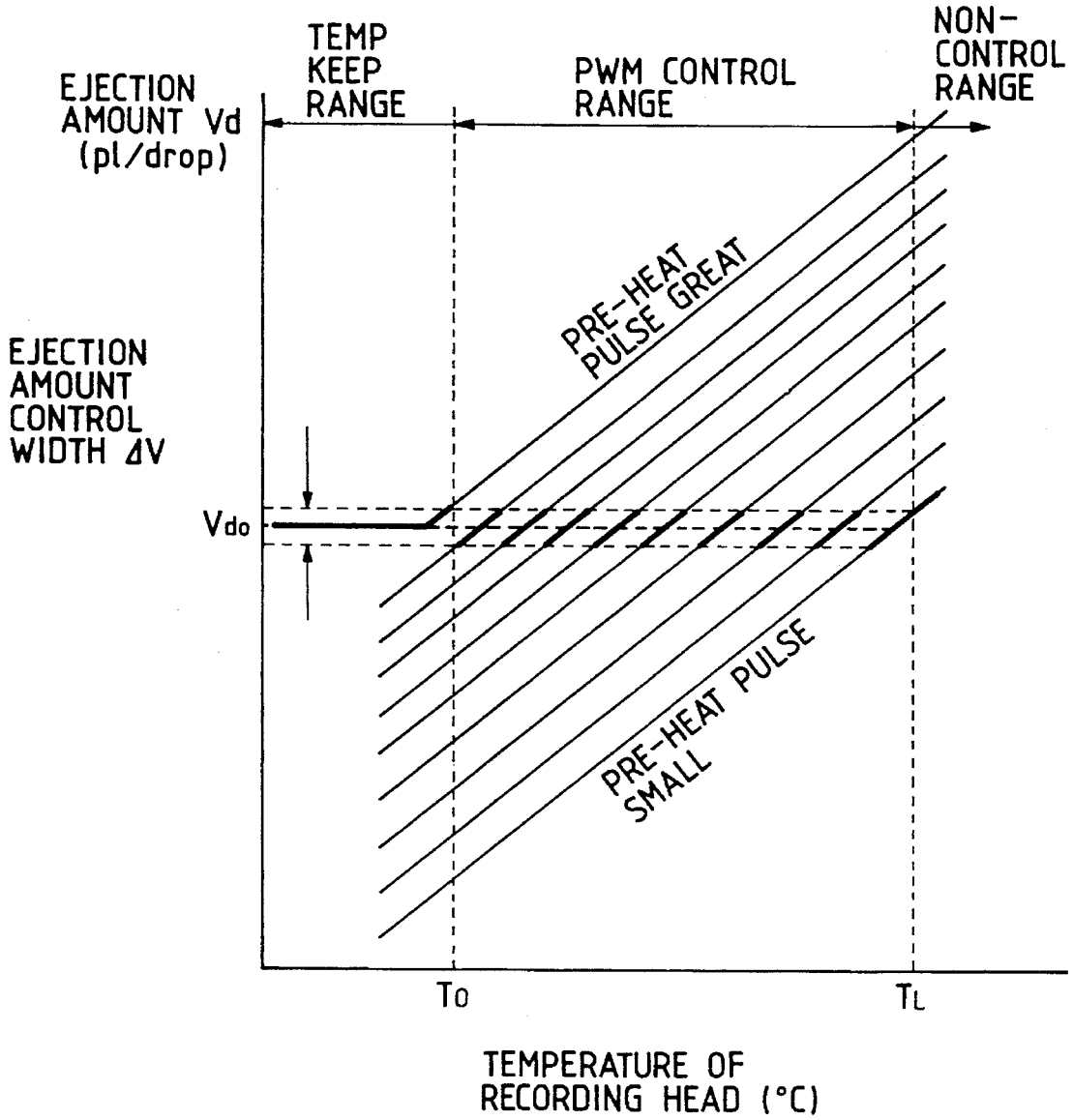
FIG. 13 shows the PWM discharge amount control in an embodiment 5.

FIG. 13 shows the discharge amount control (PWM control) in the present embodiment. When the recording head of the present embodiment is driven under the fixed drive condition, the amount of discharge increases substantially linearly as the temperature of the recording head rises. On the other hand, when the temperature of the recording head is constant, the amount of discharge increases as the pre-heat pulse is larger. FIG. 13 shows a relation between the temperature of the recording head discharge unit and the amount of discharge when the magnitude of the pre-heat pulse is varied stepwise. Accordingly, in order to control the amount of charge to Vd0 in the temperature range of T0 to TL of the recording head, the pre-pulse may be reduced stepwise as the recording head temperature rises as shown by a thick solid line in FIG. 13 so that it is stabilized in the range of the discharge amount control width ΔV.

In the present embodiment, in accordance with the measurement by the temperature sensor of the recording head, the width of the pre-pulse is set by referring to the recording head temperature versus pre-pulse table shown in FIGS. 14A to 14C. The pre-heat width is preferably set to the range which does not cause the bubbles. To this end, on a lower temperature side, the temperature holding control by using a temperature controlling heater is conducted and on a high temperature side, the minimum value of the preheat is 0 and the PWM control cannot be conducted at a higher temperature.

In the present embodiment, the width of the pre-heat pulse is modulated by the temperature of the recording head so that the variation of the amount of discharge due to the change of the temperature of the recording head is suppressed and the stable discharge is attained. As described above, the heat generated by the pre-heat pulse is an important factor to control the amount of discharge and the variation of the generated heat reduces the stability of control.

In the present embodiment, the drive condition (FIG. 8) relating to the main heat which imparts the minimum energy condition to discharge the ink and the drive condition (FIGS.

Figure 15:
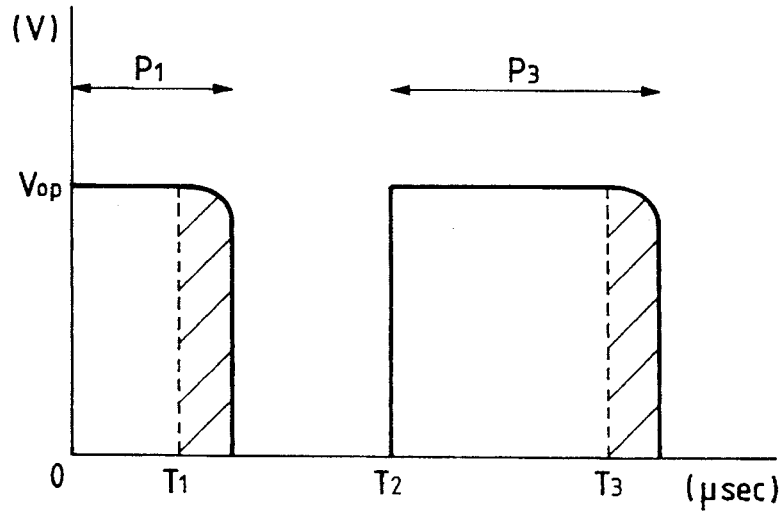
FIG. 15 shows a fall characteristic of a drive pulse in the embodiment 5.

14A, 14B and 14C) of the pre-heat pulse which imparts the condition for the preliminary heat energy are determined by the measurement of the heat generation characteristic derived by the combination of the recording head and the recording apparatus. FIGS. 14A, 14B and 14C show three different tables of the recording heat temperature versus the pre-heat pulse. FIG. 14A shows a table which is suitable for the combination of the standard recording head and the standard recording apparatus, FIG. 14B shows a table for a smaller generated heat (smaller temperature rise width in the thermal characteristic measurement), and FIG. 14C shows a table for a larger generated heat. In the multipulse drive of the present embodiment, if a variation is included in the fall characteristic of the drive pulse as shown by hatching in FIG. 15, the variation affect two times as much as that of the single pulse drive because the fall of the pulse occurs two times. Accordingly, the present invention which allows the setting of the optimum drive condition by correcting the variation of the drive of the recording head and the recording apparatus is particularly advantageous. Further, the temperature detecting sensor arranged in the recording head may be used in common in setting the drive condition and in the PWM control, and it is very efficient in constructing the apparatus.

(Embodiment 6)

In the above embodiments, the heat generation characteristic of the discharging heater is noticed as the thermal characteristic of the recording head in setting the drive condition of the recording head. In the present embodiment, in order to further improve the precision of the measurement of the thermal characteristic, the measurement of the heat dissipation characteristic of the recording head is added in correcting the heat generation characteristic of the discharging heater.

As explained in the above embodiments, the heat generation characteristic of the recording head varies by the variation of the electrical characteristic such as a resistance of the discharging heater formed on the heater board. A contact between the heater board 5100 and the support 5300 may not be uniform or the thickness of a protection layer of the heater board or the insulating layer may include a variation, which causes a manufacture variation in the heat dissipation characteristic.

The temperature rise width of the recording head measured in the thermal characteristic measurement is primarily affected by a heat generation characteristic, but the correction of the heat dissipation characteristic is necessary to measure the heat generation of the discharging heater at a higher precision. Namely, since thermal conduction occurs from the discharging heater to respective elements during the heat generation, the heat generated by the discharging heater is thermally conducted to the support when the measurement time of several seconds is required, and if the variation of the heat dissipation characteristic is large, the degrees of thermal conduction to the support differ from each other and there is a difference between the temperature rise widths of the recording head even if the heat generations are equal. In the present embodiment, the variation of the heat dissipation characteristic is corrected to attain high precision in the measurement of the heat generation of the discharging heater.

Figure 16:
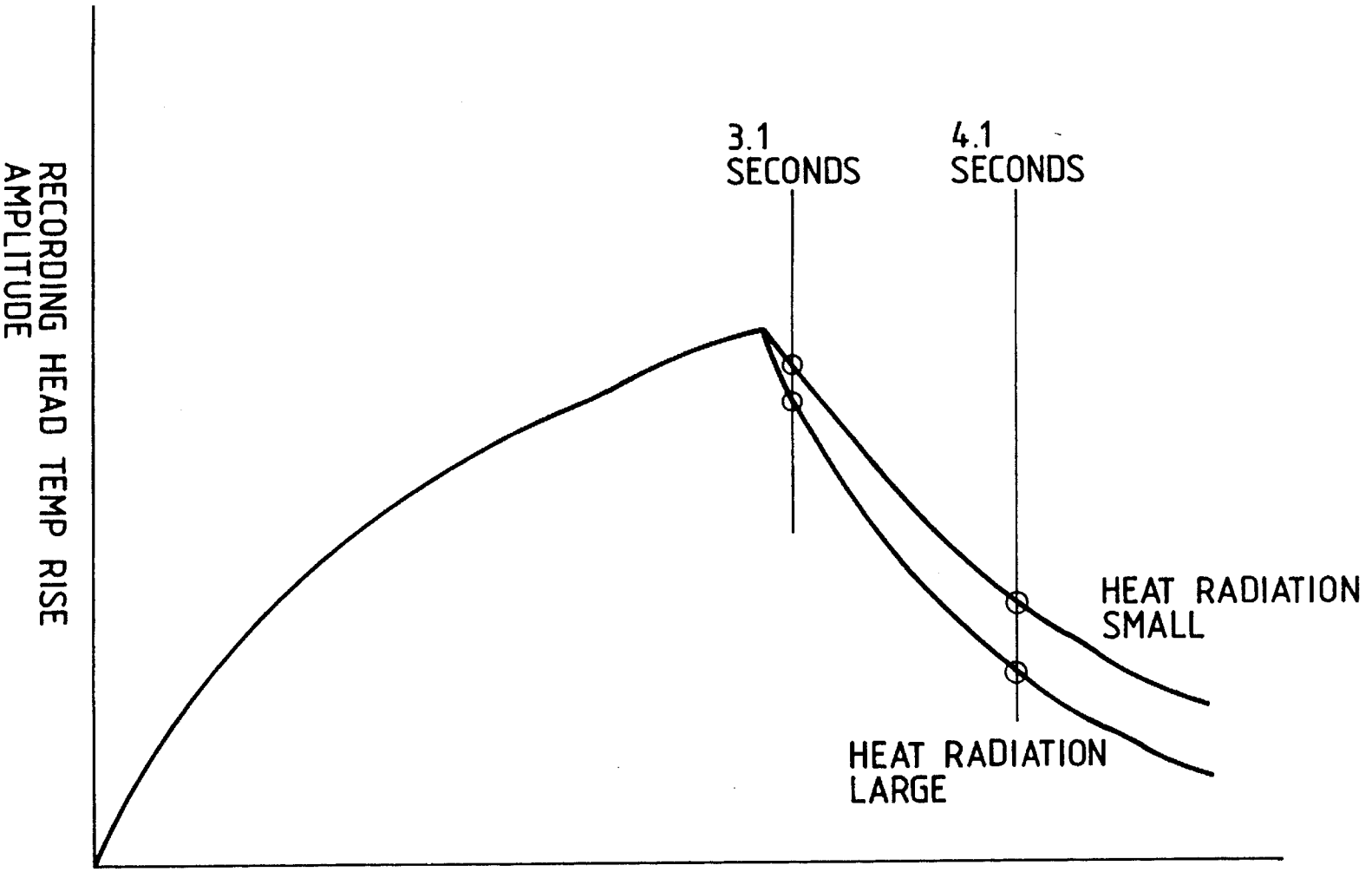
FIG. 16 shows the measurement of a heat dissipation characteristic in an embodiment 6 of the present invention.

An example of heat dissipation characteristic is shown in FIG. 16. After the completion of the predetermined heating, the temperature rise width of the recording head is measured at time points of 3.1 seconds and 4.1 seconds in FIG. 16 to determine the magnitude of the heat dissipation characteristic. Depending on the magnitude of the heat dissipation characteristic, the drive condition setting table is selected as shown in FIG. 17 to set the driving condition. In order to attain more precise correction of the heat dissipation characteristic, the classification may be in more than two classes or the measurement points for the heat dissipation characteristic may be increased and the measurements may be compared with a plurality of heat dissipation characteristic table to identify the heat dissipation characteristic.

The temperature of the recording head may be determined by calculation as described below. By measuring the heat generation characteristic and the heat dissipation characteristic, the heat generation of the discharging heater which is the heat source may be estimated by calculation.

$\Delta T(t)$: Temperature rise of the recording head

A: Equilibrium temperature of the recording head when heated under the predetermined heating condition.

M: Thermal time constant of the recording head t: Elapsed time tl: Heating stop time period The temperature during heating is given by:

$$\Delta T(t)=A*\{1-\exp(-M*t)\}$$

When the heating is stopped, it is given by:

$$\Delta T(t)=A*\{\exp[-M(t-tl)]-\exp(-M*t)\}$$

By measuring the heat generation characteristic and the heat dissipation characteristic, the thermal time constant of the recording head may be generally estimated and the equilibrium temperature of the recording head when it is driven under the predetermined drive condition, that is, the heat generation characteristic of the discharging heater may be estimated.

The above calculation may be carried out in the recording apparatus but it may be an approximate calculation. Namely, based on the data calculated and measured for various parameters of predetermined interval, which parameter combination the data of the heat generation and heat dissipation characteristics of the recording apparatus is closest to may be determined by comparison to approximate the heat generation and set the drive condition. This is advantageous in terms of operation speed. Further, strict setting may be attained even if thermal time constants of respective elements differ from recording head to recording head.

(Embodiment 7)

In the present embodiment, the temperature of the recording head is detected by the temperature sensor and it is compared with a predicted temperature calculated based on a duty factor to drive the recording head. A deviation of the heat generation condition of the discharging heater which is the basic data in calculating the predicted temperature is also detected to reestablish or finely adjust the drive condition of the recording head.

The prediction of the temperature of the recording head in the present embodiment is performed by using a distribution of the duty factor calculated from the number of dots of image data which actually drives the recording head. In the present embodiment, the duty factor is calculated for each reference time period which is derived by dividing the recording time be a predetermined interval, and the prediction of the temperature and the PWM control described above are sequentially conducted for each of the reference periods. In the present embodiment, the mere number of dots is not used because the energy supplied to the recording head differ with the width of the pre-pulse even if the number of dots is same. By using the concept of the duty factor, the same table may be used even if the width of the drive pulse such as the pre-pulse changes by the PWM control. The predicted temperature of the recording head is determined by accumulating each remaining temperature rise increment in accordance with the duty factor in each reference period by a temperature fall table of FIG. 18 shown by an elapsed time from the reference period to produce a remaining temperature rise increment for all reference periods prior to the reference period under consideration for the estimation of the temperature of the recording head, which is effective at the reference time under consideration (the remaining temperature rise increment is not zero), and adding it to the reference temperature as the temperature rise increment at that time point.

In the estimation of the temperature of the recording head described above, the calculation is made assuming that the heat generation of the discharging heater is standard one, but since the heat generation of the discharging heater differs depending on the combination of the recording head and the recording apparatus, there may be an error between the detected value of the temperature sensor of the recording head and the predicted temperature. In the present embodiment, this error is used to estimate the heat generation of the discharging heater to reestablish the driving condition. The driving condition may be set by taking the correction by the measurement of the heat dissipation characteristic explained above into account, and an optimum table to the recording head may be selected from a plurality of temperature fall tables prepared with thermal constants.

In the present embodiment, since the driving condition may be reestablished while actual recording operation is being performed, the driving condition may not be changed in one step but it may be gradually approached to the calculated driving condition by repeating the reestablishment to finally reach the optimum driving condition.

In the embodiments described above, the setting of the driving condition of the discharging heater has been explained as the setting of the driving condition of the recording head, the present invention is also applicable to the setting of the driving condition of the temperature adjusting heater. This is particularly effective because the heat generation characteristic of the temperature adjusting heater may be stabilized in the prediction of the temperature of the recording head described in the above embodiment.

The present invention is particularly effective in the replaceable head type but it may also be applicable to a non-replaceable head, that is, a permanent type.

The present invention is further applicable to not only the ink jet type recording system which discharges ink by using thermal energy but also to a thermo-sensitive system or a thermal transfer system.

In accordance with the present invention, the thermal characteristic of the head mounted is measured and the driving condition of the head is set in accordance with the thermal characteristic. Thus, the driving condition of the recording head may be self-set with a high precision and simple construction and the stabilization of the recording characteristic and the long lifetime of the replaceable head are attained.

The present invention is particularly suitably usable in an ink jet recording head and a recording apparatus in which an electro-thermal transducer, a laser beam or the like is used to cause a change of state of the ink to eject or discharge the ink, because the high density of pixels and high resolution of recording are attained.

The typical construction and the operational principles are preferably the ones disclosed in U.S. Pat. No. 4,723,129 and U.S. Pat. No. 4,740,796. The principle and the structure are applicable to a so-called on-demand type recording system and a continuous type recording system. Particularly, however, it is suitable for the on-demand type because the principle is such that at least one driving signal is applied to an electro-thermal transducer disposed on a liquid (ink) retaining sheet or liquid passage, the driving signal being large enough to provide such a quick temperature rise beyond a departure from nucleation boiling point, by which the thermal energy is provided by the electro-thermal transducer to produce film boiling on the heating portion of the recording head, whereby a bubble can be formed in the liquid (ink) corresponding to each of the driving signals. By the generation, development and contraction of the bubbles, the liquid (ink) is ejected through a discharge port to produce at least one droplet. The driving signal is preferably in the form of pulse because the development and the contraction of the bubbles can be effected instantaneously, and therefore the liquid (ink) is ejected with fast response. The driving signal is preferably such as those disclosed in U.S. Pat. No. 4,463,359 and U.S. Pat. No. 4,345,262. In addition, the temperature rise rate of the heating surface is preferably such as those disclosed in U.S. Pat. No. 4,313,124.

The structure of the recording head may be those shown in U.S. Pat. No. 4,558,333 and U.S. Pat. No. 4,459,600 in which the heating portion is disposed at a bent portion, as well as the structure of the combination of the ejection outlet, liquid passage and the electro-thermal transducer disclosed in the above-mentioned patents. In addition, the present invention is applicable to the structure disclosed in Japanese Laid-Open Patent Application No. 59-123670 in which a common slit is used as the discharge port for a plurality of electro-thermal transducers, and the structure disclosed in Japanese Laid-Open Patent Application No. 59-138461 in which an opening for absorbing a pressure wave of thermal energy is formed corresponding to the discharge port. This is because the present invention is effective to perform the recording with certainty and high efficiency irrespective of the type of the recording head.

Further, the present invention is applicable to a serial type recording head in which the recording head is fixed on a main assembly, to a replaceable chip type recording head which is connected electrically with the apparatus and can be supplied with the ink when it is mounted in the main assembly, or to a cartridge type recording head having an integral ink container.

The provision of the recovery means and/or the auxiliary means for the preliminary operation are preferable because they further stabilize the effects of the present invention. As for such means, there are capping means for the recording head, cleaning means therefor, pressurizing or suction means, preliminary heating means which may be an electro-thermal transducer, an additional heating element or a combination thereof. Also, means for effecting preliminary discharge (not for the recording) may stabilize the recording operation.

As regards the variation of the recording head mountable, it may be a single head for a single color ink or plural heads for a plurality of inks having different colors or densities. The present invention is effectively applicable to an apparatus having at least one of a monochromatic mode mainly with black, a multi-color mode with different color inks and/or a full color mode using the mixture of colors, which may be an integrally formed recording unit or a combination of a plurality of recording heads.

Furthermore, in the foregoing embodiment, the ink is liquid. Alternatively, ink which is solidified below room temperature and liquefied at room temperature may be used. Since the ink is controlled within a temperature range of not lower than 30° C. and not higher than 70° C. to stabilize the viscosity of the ink to provide the stable discharge in a conventional recording apparatus of this type, the ink may be such that it is liquid within the temperature range when the recording signal is applied. In one of them, the temperature rise due to the thermal energy is positively prevented by consuming it for the state change of the ink from the solid state to the liuqid state. Other ink is solidified when it is left unused, to prevent the evaporation of the ink. In any case, upon the application of the recording signal producing thermal energy, the ink is liquefied, and the liquefied ink may be discharged. Other ink may start to be solidified at the time when it reaches the recording sheet. The present invention is also applicable to the ink which is liquefied by the application of the thermal energy. Such ink may be retained in liquid state or solid state in holes or recesses formed in a porous sheet as disclosed in Japanese Laid-Open Patent Application No. 54-56847 and Japanese Laid-Open Patent Application No. 60-71260. The sheet is faced to the electro-thermal transducers. The most effective one of the inks described above is the film boiling system.

The ink jet recording apparatus may be used as an output terminal of an information processing apparatus such as a computer or the like, as a copying machine combined with an image reader or the like, or as a facsimile machine having information sending and receiving functions.

While the invention has been described with reference to the structures disclosed herein, it is not confined to the details set forth and the present invention is intended to cover such modifications or changes as may come within the objects of the improvements or the scope of the claims.

What is claimed is:

1. A recording apparatus having a recording head mounted thereon for recording by using thermal energy, the recording head having a thermal characteristic, said apparatus comprising:

heat means for driving and heating said mounted recording head under predetermined conditions;

detection means for detecting a temperature change of said recording head caused by the heating by said heat means;

determination means for determining the thermal characteristic of said recording head based on the temperature change detected by said detection means;

set means for setting a driving condition of said mounted recording head in accordance with the thermal characteristic of said recording head determined by said determination means; and drive means for driving said recording head in accordance with the driving condition set by said set means.

2. A recording apparatus according to claim 1, wherein said detection means detects the temperature change including thermal peak.

3. A recording apparatus according to claim 2, wherein the predetermined conditions under which said heat means drives and heats said mounted recording head include a heating period and said detection means detects the temperature change by measuring temperature changes immediately before start of the heating period and immediately after end of the heating period.

4. A recording apparatus according to claim 1, wherein said detection means detects the temperature change by measuring a temperature change in a period containing a heating period and a temperature change in a heat dissipation period.

5. A recording apparatus according to claim 1, wherein said detection means comprises a temperature sensor in said recording head for detecting the temperature of said recording head.

6. A recording apparatus according to claim 5, wherein said heat means, said detection means and said set means are activated when the temperature change of said temperature sensor is small.

7. A recording apparatus according to claim 5, wherein said heat means, said detection means and said set means are temporarily activated when the temperature change of said temperature sensor is large, and finally activated when the temperature change is small.

8. A recording apparatus according to claim 1, wherein said heat means, said detection means and said set means are activated when a power supply of said recording apparatus is turned on.

9. A recording apparatus according to claim 1, wherein said recording head discharges ink by using thermal energy.

10. A recording head according to claim 9, wherein said heat means, said detection means and said set means are activated immediately after a discharge recovery process of said recording head.

11. A recording apparatus according to claim 9, wherein said heat means drives said recording head to discharge ink from said recording head.

12. A recording apparatus according to claim 9, wherein said heat means drives said recording head not to discharge ink from said recording head.

13. A recording apparatus according to claim 1, wherein said recording head includes a plurality of recording elements, said heat means drives said recording head with different conditions for the recording elements to be simultaneously driven, said detection means detects the temperature change of said recording head in accordance with said conditions, and said set means sets the driving condition to said recording head in accordance with the temperature changes corresponding in number to the number of recording elements to be driven.

14. A recording apparatus according to claim 1, wherein said recording head records in a plurality of colors.

15. A recording apparatus according to claim 14, wherein said heat means, said detection means and said set means are sequentially activated for each of the plurality of colors.

16. A recording apparatus according to claim 14, wherein said heat means, said detection means and said set means are simultaneously activated for the plurality of colors.

17. A recording apparatus according to claim 1, wherein said recording head is replaceably mounted on said recording apparatus.

18. A recording apparatus according to claim 1, wherein said recording head is permanently mounted on said recording apparatus.

19. A recording apparatus according to claim 1, wherein said recording head includes a heater for adjusting a temperature of said recording head, and said set means sets a driving condition of said heater.

20. A recording apparatus according to claim 1, wherein said set means sets a width of a drive pulse of said recording head.

21. A recording apparatus according to claim 20, wherein said set means sets a width of a pre-pulse which precedes the drive pulse of said recording head.

22. A recording apparatus according to claim 1, wherein said set means sets a drive voltage of said recording head.

23. A recording apparatus according to claim 1, further comprising a carriage for carrying said recording head.

24. A recording apparatus according to claim 1, further comprising transport means for transporting a recording medium on which data is recorded by said recording head.

25. A recording apparatus according to claim 1, wherein said recording apparatus is incorporated in a copying machine.

26. A recording apparatus according to claim 1, wherein said recording apparatus is incorporated in a facsimile machine.

27. A recording apparatus according to claim 1, wherein said recording apparatus is incorporated in a computer terminal.

28. A recording apparatus having a recording head mounted thereon for discharging ink by energizing a heat generating element, said recording head having a thermal characteristic, said apparatus comprising:

heat generation means for energizing the heat generating element of said mounted recording head under predetermined conditions;

detection means for detecting a temperature change of said recording head caused by the energization by said heat generation mean;

determination means for determining the thermal characteristic of said recording head based on the temperature chance detected by said detection means;

set means for setting a driving condition for energization for recording of the heat generating element of said mounted recording head in accordance with the thermal characteristic of said recording head determined by said determination means; and drive means for driving the heat generating element of said recording head for recording in accordance with the driving condition set by said set means.

29. A recording apparatus according to claim 28, wherein said detection means detects the temperature change including a thermal peak.

30. A recording apparatus according to claim 29, wherein the predetermined conditions under which said heat generation means energizes the heat generating element include a heating period and said detection means detects the temperature change by measuring temperature changes immediately before start of the heating period and immediately after end of the heating period.

31. A recording apparatus according to claim 28, wherein said detection means detects the temperature change by measuring a temperature change in a period containing a heating period and a temperature change in a heat dissipation period.

32. A recording apparatus according to claim 28, wherein said detection means comprises a temperature sensor in said recording head for detecting the temperature of said recording head.

33. A recording apparatus according to claim 32, wherein said heat means, said detection means and said set means are activated when the temperature change of said temperature sensor is small.

34. A recording apparatus according to claim 28, wherein said heat means, said detection means and said set means are activated when a power supply of said recording apparatus is turned on.

35. A recording head according to claim 28, wherein said heat means, said detection means and said set means are activated immediately after a discharge recovery process of said recording head.

36. A recording apparatus according to claim 28, wherein said heat means drives said recording head to discharge ink from said recording head.

37. A recording apparatus according to claim 28, wherein said heat means drives said recording head not to discharge ink from said recording head.

38. A recording apparatus according to claim 28, wherein said recording head records in a plurality of colors.

39. A recording apparatus according to claim 28, wherein said recording head is replaceably mounted on said recording apparatus.

40. A recording apparatus according to claim 28, wherein said recording head is permanently mounted on said recording apparatus.

41. A recording apparatus according to claim 28, wehrein said set means sets a width of a drive pulse of said recording head.

42. A recording apparatus according to claim 41, wherein said set means sets a width of a pre-pulse which precedes the drive pulse of said recording head.

43. A recording apparatus according to claim 28, wherein said set means sets a drive voltage of said recording head.

44. A recording apparatus according to claim 28, further comprising a carriage for carrying said recording head.

45. A recording apparatus according to claim 28, further comprising transport means for transporting a recording medium on which data is recorded by said recording head.

46. A recording apparatus according to claim 28, wherein said recording apparatus incorporated in to a copying machine.

47. A recording apparatus according to claim 28, wherein said recording apparatus incorporated in a facsimile machine.

48. A recording apparatus according to claim 28, wherein said recording apparatus is incorporated a computer terminal.

49. A recording apparatus having a recording head mounted thereon for recording by using thermal energy, said recording head having a predetermined thermal characteristic and being driven by a drive duty, said apparatus comprising: p1 estimation means for estimating an estimated temperature of said recording head in accordance with the drive duty of said mounted recording head based on the predetermined thermal characteristic;

detection means for detecting an actual temperature of said recording head;

determination means for determining the predetermined thermal characteristic of said recording head based on a difference between the estimated temperature of said recording head estimated by said estimation means and the actual temperature of said recording head detected by said detection means set means for setting a drive condition of said mounted recording head in accordance with the predetermined thermal characteristic determined by said determination means; and drive means for driving said recording head in accordance with the driving condition set by said set means.

50. A recording apparatus according to claim 49, wherein said recording head discharges ink by using thermal energy.

51. A method for recording with a recording head by using thermal energy, said method comprising the steps of:

measuring a first temperature of said recording head;

heating said recording head by energizing said recording head;

measuring a second temperature of said recording head after the start of heating;

detecting a thermal characteristic of said recording head based on the measured first and second temperatures of said recording head;

setting a driving condition of said recording head in accordance with the detected thermal characteristic; and energizing said recording head for recording in accordance with the set driving condition.

52. A method for recording according to claim 51, wherein said step of measuring the second temperature detects the temperature of said recording head after the end of said heating step.

53. A method for recording according to claim 51, further comprising the step of:

measuring a temperature change of said recording head prior to said step of measuring the first temperature, wherein said step of measuring the first temperature is executed when the measured temperature change is small.

54. A method for recording according to claim 51, further comprising the steps of:

measuring a third temperature of said recording head after said step of measuring the second temperature;

measuring a fourth temperature of said recording head after said step of measuring the third temperature; and detecting a heat dissipation characteristic of said recording head based on the measured third and fourth temperatures of said recording head;

wherein said step of setting sets the driving condition of said recording head in accordance with the detected heat dissipation characteristic, in addition to the thermal characteristic.

55. A method for recording according to claim 51, wherein said recording head discharges ink by using thermal energy.

56. An ink jet recording apparatus having a replaceable thermal head mounted thereon, the replaceable thermal head having a thermal characteristic. said apparatus comprising:

thermal characteristic determination means for determining the thermal characteristic of said thermal head by energizing said thermal head; and set means for setting a driving condition of said thermal head in accordance with the thermal characteristic determined by said determination means.

57. An ink jet recording apparatus according to claim 56, wherein said set means determines the driving condition by a table for correcting a change curve including a peak of the thermal characteristics to a predetermined curve.

58. An ink jet recording apparatus according to claim 56, wherein said determination means Comprises recording head temperature detection means for measuring temperature changes during heating and heat dissipation when said thermal head is energized, and estimation means for estimating a heat generation characteristic of said thermal head by using data of the temperature changes.

* * * * *

UNITED STATES PATENT AND TRADEMARK OFFICE

CERTIFICATE OF CORRECTION

PATENT NO. : 5,576,745 Page 1 of 4

DATED : November 19, 1996

INVENTOR(S) : Miyuki MATSUBARA

It is certified that error appears in the above-indentified patent and that said Letters Patent is hereby corrected as shown below:

COLUMN 2:

Line 15, "character- istic." should read --characteristic.--.

COLUMN 3:

Line 16, "measures" should read --measured--.

COLUMN 4:

Line 67, "heat" should read --heater--.

COLUMN 5:

Line 39, "by" should read --by a--.

COLUMN 6:

Line 16, "200" should read --200--;
Line 23, "manufacture" should read --manufacturing--.

COLUMN 8:

Line 5, "affect" should read --effect--;

UNITED STATES PATENT AND TRADEMARK OFFICE

CERTIFICATE OF CORRECTION

PATENT NO. : 5,576,745

DATED : November 19, 1996

INVENTOR(S) : Miyuki MATSUBARA

It is certified that error appears in the above-indentified patent and that said Letters Patent is hereby corrected as shown below:

Line 10, "to generate" should read --generation of--.

COLUMN 9:

Line 16, "actually which" should read --which actually--;
Line 66, "affect" should read --effect--.

COLUMN 10:

Line 48, "we" should read --in--.

COLUMN 11:

Line 5, "affect" should read --effect--;
Line 62, "groups,as" should read --groups as--.

COLUMN 12:

Line 9, "dischage" should read --discharge--.

COLUMN 13:

Line 6, "heat" should read --head--;
Line 15, "affect" should read --effect is--;

UNITED STATES PATENT AND TRADEMARK OFFICE

CERTIFICATE OF CORRECTION

PATENT NO. : 5,576,745

DATED : November 19, 1996

INVENTOR(S) : Miyuki MATSUBARA

It is certified that error appears in the above-indentified patent and that said Letters Patent is hereby corrected as shown below:

Line 45, "manufacture" should read --manufacturing--.

COLUMN 14:

Line 11, "table" should read --tables--;
Line 64, "be" should read --by--.

COLUMN 15:

Line 2, "differ" should read --differs--;
Line 20, "is" should read --is a--;
Line 30, "to" should read --for--;
Line 42, "the" should read --but the--.

COLUMN 19:

Line 26, "mean;" should read --means;--;
Line 29, "chance" should read --change--.

COLUMN 20:

Line 17, "wehrein" should read --wherein--;
Line 30, "apparatus" should read --apparatus is-- and "to" should be deleted;

UNITED STATES PATENT AND TRADEMARK OFFICE

CERTIFICATE OF CORRECTION

PATENT NO. : 5,576,745 Page 4 of 4

DATED : November 19, 1996

INVENTOR(S) : Miyuki MATSUBARA

It is certified that error appears in the above-indentified patent and that said Letters Patent is hereby corrected as shown below:

Line 33, "apparatus" should read --apparatus is--;

Line 36, "a" should read --in a--;

Line 42, "p1" should be deleted, and "estimation" should begin a new paragraph;

Line 54, "means" should read --means;--.

COLUMN 22:

Line 10, "characteristic." should read --characteristic,--;

Line 22, "characteristics" should read --characteristic--;

Line 24, "Comprises" should read --comprises--.

Signed and Sealed this

Twenty-ninth Day of April, 1997

Bruce Lehman

*Attest:*

BRUCE LEHMAN

*Attesting Officer*

*Commissioner of Patents and Trademarks*